US010364058B2

(12) United States Patent
Wiley

(10) Patent No.: US 10,364,058 B2
(45) Date of Patent: Jul. 30, 2019

(54) REVERSE TUCK LOCK

(71) Applicant: Ted E. Wiley, Dover, AR (US)

(72) Inventor: Ted E. Wiley, Dover, AR (US)

(73) Assignee: INNOVATIVE DESIGN CONCEPTS, INC., Dover, AR (US)

( * ) Notice: Subject to any disclaimer, the term of this patent is extended or adjusted under 35 U.S.C. 154(b) by 0 days.

(21) Appl. No.: 15/284,243

(22) Filed: Oct. 3, 2016

(65) Prior Publication Data

US 2017/0096251 A1 Apr. 6, 2017

Related U.S. Application Data

(63) Continuation of application No. 14/947,469, filed on Nov. 20, 2015, now abandoned.

(Continued)

(51) Int. Cl.
*B65D 5/30* (2006.01)
*B65D 5/468* (2006.01)

(Continued)

(52) U.S. Cl.
CPC ..... *B65D 5/308* (2013.01); *B31B 50/60* (2017.08); *B65D 5/0015* (2013.01); *B65D 5/106* (2013.01);

(Continued)

(58) Field of Classification Search
CPC ..... B65D 5/308; B65D 5/0015; B65D 5/106; B65D 5/4608; B65D 81/26;

(Continued)

(56) References Cited

U.S. PATENT DOCUMENTS 1,796,035 A * 3/1931 Maier ..... B65D 5/308 229/195
2,019,787 A 11/1935 Leopold (Continued)

FOREIGN PATENT DOCUMENTS

CH 2861027 Y 1/2007
CH 103448979 12/2013

(Continued)

OTHER PUBLICATIONS

Unknown, 5lb. Mushroom Container.

(Continued)

*Primary Examiner* — Christopher R Demeree
(74) *Attorney, Agent, or Firm* — Kutak Rock LLP; Sara Weilert Gillette

(57) ABSTRACT

A foldable container moveable between a flat configuration and a three-dimensional configuration is provided. The container includes a first panel having a first engagement feature, a second panel having a second engagement feature, and a third panel having a third engagement feature. The first engagement feature is configured to engage with the second engagement feature so as to secure the container in the three-dimensional configuration. The first engagement feature is also configured to engage with the third engagement feature so as to inhibit the first engagement feature from becoming disengaged from the second engagement feature.

13 Claims, 22 Drawing Sheets

Related U.S. Application Data

(60) Provisional application No. 62/236,419, filed on Oct. 2, 2015.

(51) Int. Cl.

| | |
|---|---|
| ***B65D 5/20*** | (2006.01) |
| ***B65D 5/42*** | (2006.01) |
| ***B65D 81/26*** | (2006.01) |
| ***B65D 5/00*** | (2006.01) |
| ***B65D 5/10*** | (2006.01) |
| ***B31B 50/60*** | (2017.01) |
| *B31B 50/73* | (2017.01) |
| *B31B 100/00* | (2017.01) |

(52) U.S. Cl.
CPC ..... *B65D 5/2038* (2013.01); *B65D 5/307* (2013.01); *B65D 5/4266* (2013.01); *B65D 5/4608* (2013.01); *B65D 81/26* (2013.01); *B31B 50/734* (2017.08); *B31B 2100/0024* (2017.08)

(58) Field of Classification Search
CPC .. B65D 21/0212; B65D 5/4212; B65D 85/70; B65D 5/22; B31B 1/60; B31B 2201/6091
USPC ..... 229/198.2, 125.28, 148, 149, 153, 194, 229/5.5
See application file for complete search history.

(56) References Cited

U.S. PATENT DOCUMENTS

| | | | | | |
|---|---|---|---|---|---|
| 2,459,939 | A | | 1/1949 | Hill | |
| 2,660,363 | A | * | 11/1953 | Trickett, Jr. | B65D 5/308 229/117.16 |
| 3,039,600 | A | | 6/1962 | Bellows | |
| 3,381,880 | A | | 5/1968 | Carle et al. | |
| 4,139,146 | A | * | 2/1979 | Bamburg | B65D 5/307 229/119 |
| 4,171,763 | A | * | 10/1979 | Card | B65D 5/46088 229/117.15 |
| 4,238,069 | A | | 12/1980 | Morris, Jr. | |
| 4,365,738 | A | | 12/1982 | Densen | |
| 4,392,607 | A | | 7/1983 | Perkins, Jr. | |
| 4,676,429 | A | | 6/1987 | Crowe et al. | |
| 4,702,408 | A | | 10/1987 | Powlenko | |
| 4,844,331 | A | | 7/1989 | Oldfather | |
| 4,856,705 | A | | 8/1989 | Carr et al. | |
| 5,016,814 | A | | 5/1991 | Fullerton | |
| 5,139,196 | A | | 8/1992 | Fry et al. | |
| 5,398,868 | A | * | 3/1995 | Densen | B65D 5/22 229/125.08 |
| D361,892 | S | | 9/1995 | Quaintance | |
| 5,531,374 | A | | 7/1996 | Gasper | |
| 5,630,543 | A | | 5/1997 | Dugan | |
| 5,853,121 | A | | 12/1998 | Francisco | |
| 5,915,617 | A | | 6/1999 | Gasper | |
| 7,328,833 | B1 | | 2/2008 | Wiley | |
| 7,654,440 | B2 | | 2/2010 | Quaintance et al. | |
| 9,045,250 | B2 | | 6/2015 | Henderson et al. | |
| 2004/0211825 | A1 | | 10/2004 | Champion et al. | |
| 2008/0078819 | A1 | | 4/2008 | Strong et al. | |
| 2009/0057382 | A1 | | 3/2009 | Churvis | |
| 2009/0121001 | A1 | | 5/2009 | Perez et al. | |

FOREIGN PATENT DOCUMENTS

| | | |
|---|---|---|
| FR | 2995286 | 3/2014 |
| WO | 9807629 | 2/1998 |

OTHER PUBLICATIONS

International Search Report for PCT/US2014/036014 dated Sep. 24, 2014.
Written Opinion for PCT/US2014/036014 dated Sep. 24, 2014.

* cited by examiner

REVERSE TUCK LOCK

CROSS REFERENCES

This application is a continuation application of co-pending U.S. patent application Ser. No. 14/947,469, filed Nov. 20, 2015, which claims priority pursuant to 35 U.S.C. 119(e) to U.S. Provisional Patent Application Ser. No. 62/236,419, titled "Foldable Container", filed Oct. 2, 2015, the entire disclosures of which are incorporated herein by reference. Furthermore, this application claims directly the benefit of, and priority based upon, U.S. Provisional Patent Application Ser. No. 62/236,419, titled "Foldable Container", filed Oct. 2, 2015, the entire disclosure of which is herein incorporated by reference.

FIELD OF THE INVENTION

The present invention relates generally to foldable containers. More specifically, the present invention is concerned with a locking feature for securing foldable containers in a three-dimensional configuration.

BACKGROUND OF THE INVENTION

Foldable containers are commonly used to store and/or ship various products. Foldable containers provide benefits over non-foldable containers at least because foldable containers can be folded from a flat configuration into a three-dimensional configuration.

It is much easier to ship and store containers when they are in a flat configuration. Consequently, containers are usually not moved from their flat configurations into their three-dimensional configurations until they are needed. This often results in the containers being assembled by personnel that may or may not be familiar with the process of folding a particular container. Consequently, it would be beneficial for the container to be designed such that it is relatively obvious how to move the container from a flat configuration into a three-dimensional configuration.

Once the container is folded into a three-dimensional configuration, users are often required to apply tape or some other adhesive to hold the container in the three-dimensional configuration. Unfortunately, such tapes and adhesives are not always readily available. Furthermore, tapes and adhesives can damage containers, can complicate folding procedures, can limit how the container is used, and can hinder or prevent containers from later being moved back to their flat configurations for storage and/or shipping of the containers. Consequently, it would be beneficial if the container included one or more feature for securing the container in the three-dimensional configuration without requiring the user to use tapes or adhesive to hold the container in the three-dimensional configuration, especially in situations where the use of such adhesive may be prohibited and/or impractical.

Containers are often fabricated from a single piece of flat material that is folded into a three-dimensional container having a plurality of vertical panels extending upwards from a bottom panel so as to define an interior area for holding product. In some cases, the material is a special type of corrugated paperboard that includes one or more layer of special material so as to accommodate particular products being in direct contact with the various panels of the box.

Some containers are subject to environmental conditions and/or damaging substances. For instance, frozen chicken is often shipped in containers stacked within refrigerated trailers and ice is typically placed on top of the chicken, placing the ice in direct contact with the containers. In this way, the chicken is maintained below a threshold temperature so as to prolong the shelf-life of the chicken, to decrease the risk of the chicken becoming contaminated, and/or to satisfy government regulations. When fully packed, each direct-contact ice-pack container is relatively heavy. For instance, just one container may hold 40 or more pounds of chicken and 10 or more pounds of ice. These containers are then stacked on top of each other in a refrigerated truck and shipped across the country, likely experiencing jostling and impact loads along the way.

As the ice melts, water flows around the chicken, sometimes causing fluid to pool within the container. These pools of fluid can create potential hazards associated with potential contamination of the chicken and/or reduced structural integrity of the container. Additional potential hazards are associated with the fluid refreezing within the container. To minimize these risks, many such containers include one or more drain hole. Unfortunately, the addition of a drain hole can decrease the structural strength of the panel. Consequently, it would be beneficial to include a drain hole in a panel while minimizing potential loss of structural strength of the panel.

Some containers of the prior art include locking features to hold the containers in their three-dimensional configurations during filling, handling, loading, shipping, and unloading. For instance, one design for a top-locking feature includes locking flanges that are coupled to hinge flanges, each hinge flange extending from a recessed portion of the top end of each primary end panel. Secondary end panels extending from each end of each side panel include corresponding recessed portions such that when the locking flanges are folded over the secondary end panels, the hinge flanges are pressed down into the recessed portions of the top ends of the secondary end panels. Unfortunately, this top-locking feature decreases the bearing surface at the top of the end panels. Furthermore, the top-locking feature is ineffective if it is not completely engaged, often causing product or other items, such as chicken and/or ice, to spill out of the container. Furthermore still, even if the top-locking feature is completely engaged, it is subject to becoming disengaged during filling, handling, loading, shipping, and/or unloading. Furthermore yet, it is often difficult or impossible to inspect the top-locking feature to determine whether the locking feature is disengaged and/or is likely to become disengaged.

Consequently, it would be beneficial to have a locking feature that does not decrease the bearing surface at the top of the end panels. Furthermore, it would be beneficial to have a locking feature that is effective even if it is not completely engaged. Furthermore still, it would be beneficial to have a locking feature that is not subject to becoming disengaged while filling and/or moving the container. Furthermore yet, it would be beneficial to have a locking feature that is easy to inspect so that a user can easily determine whether the locking feature is disengaged and/or is likely to become disengaged.

Various containers of the prior art have been developed to solve various problems and to serve various needs, but each has its limitations and drawbacks. For example, many containers include locking features for a primary panel that extend beyond the primary panel regardless of whether the panel is in a three-dimensional configuration or in a flat configuration. In other words, the locking features are created by adding material to an existing blank for a primary panel. Some such locking features require the locking feature to be cut from a secondary panel and/or from another primary panel. Other such locking features extend beyond the panels such that a larger blank stock of material is required to produce the container. Consequently, it would be beneficial to have a locking feature for a primary panel that does not extend beyond the periphery of the panel when the container is in a flat configuration.

Other limitations of the locking features of the prior art include limited strength capabilities. For instance, many such locking features include one or more feature that weakens the locking feature such that the locking feature is likely to break well before the material of the container has reached its loading capability. In many instances, this deficiency is remedied by adding tape or some other bonding agent at or near the locking feature. In other instances, however, especially when tape and/or other adhesives are not allowed or are otherwise undesirable, the locking feature is simply allowed to remain as a weak-point of the container. In some such embodiments, the locking feature tears or otherwise comes loose, allowing the container to pop open. Consequently, it would be beneficial to have a locking feature that does not require tape or any other bonding material for the locking feature to have a strength capability that is approximately equivalent to the strength capability of the material of the container.

Furthermore, many foldable containers are made from relatively flexible materials, such as corrugated paperboard, so as to accommodate the bending and folding that is required to move the container from a flat configuration to a three-dimensional configuration. To the extent that some foldable containers can be fabricated from stiffer materials, such as plastic, there are few options, many of which are not feasible for use with both flexible material and stiffer material. Consequently, it would be beneficial to have a foldable container that is capable of being fabricated from both stiff material and flexible material.

SUMMARY OF THE INVENTION

The present invention comprises a foldable container that is movable from a flat configuration to a three-dimensional configuration. While in the flat configuration, various panels of the container are folded relatively flat with each other so that a plurality of containers can be stacked on top of each other for shipping and storage of the containers themselves. While in the three-dimensional configuration, the containers define an interior area for holding items, including food items such as raw chicken, and include structural features that enable a plurality of filled containers to be stacked on top of each other so as to facilitate storing and/or shipping a large quantity of items within the containers.

Embodiments of each container include various novel features to assist users in moving the container from a flat configuration to a three-dimensional configuration and/or for allowing a user to move the container from the three-dimensional configuration back to the flat configuration without adversely affecting the structural integrity of the container. In some embodiments, a key feature is a reverse tuck lock feature that mechanically secures the container in the three-dimensional configuration. As a result, tape, adhesives, and other bonding agents are not required.

Some embodiments of a reverse tuck lock feature includes a tab member that extends through a tab slot and/or over an edge profile into an interior area of a container. While in the interior area, the tab member is moveable between a locked configuration and an unlocked configuration. In the locked configuration, the tab member secures the container in the three-dimensional configuration by inhibiting the tab member's ability to be pulled from the tab slot and/or away from the edge profile. In the unlocked configuration, the tab member enables the container to be moved from the three-dimensional configuration by allowing the tab member to be removed from the tab slot and/or away from the edge profile. In some embodiments, the edge profile defines one or more profile tab member extending from a profile of a second panel. In some embodiments, the one or more profile tab member is configured to be received by a tab slot defined by a first panel when the container is in the three-dimensional configuration.

In some embodiments, the tab member is secured in a locked configuration prior to items being placed in the interior area of the container. Unlike containers of the prior art, however, placing items in the interior area of certain embodiments of the present invention actually further secures the tab member in the locked configuration, thereby further securing the container in the three-dimensional configuration. In other words, as the load requirements of the container increase, the stability of the container increases at least because the locking feature of the container becomes less likely to become disengaged.

Even if the locking feature is not fully engaged when the container is moved into the three-dimensional configuration, placing items in the interior area of certain container of the present invention causes the tab member to move to the locked configuration and continues to bias the tab member to the locked configuration. As a result, some embodiments do not allow the container to move from the three-dimensional configuration until after the items are removed from the container.

Some embodiments of the container of the present invention also include one or more feature for providing a user with an indication as to whether the container is in a proper three-dimensional configuration and/or whether a locking feature of the container is properly engaged. For instance, some embodiments include indicia on the tab member that is only visible if the tab member has not been inserted into the interior area of the container and/or indicia on another surface of the container that is only visible if the tab member has been inserted into the interior area of the container. In this way, a user will be able to quickly and easily determine, from a distance, whether the container is properly assembled.

The present invention also solves various other problems and is capable of serving various other needs. For example, some embodiments of the present invention include a locking feature that does not extend beyond the panels of the present invention so that the size of the blank stock for the container is minimized, reducing wasted material. Furthermore, in other embodiments, the locking feature is formed entirely from the primary panel that it is intended to support in the locked configuration or is at least substantially formed from the primary panel with portions extending beyond the primary panel serving a secondary purpose of providing additional features such as defining slots and/or voids. In other words, additional material is not required for the locking feature.

Some embodiments of the present invention still further provide the benefit of providing a locking feature that includes a strength that is substantially the same as the strength of the material of the container itself, without requiring tape or any other bonding agent. Some embodiments of the present invention still further provide the benefit of providing a configuration that can be utilized with a variety of materials, with little or no regard to the relative flexibility of the material of the container. Furthermore, some embodiments of the present invention include one or more feature that makes it impossible or otherwise unlikely that the container will be assembled incorrectly. For example, in some embodiments, the container will not remain in a three-dimensional configuration at all unless the locking features are engaged in a locked configuration.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
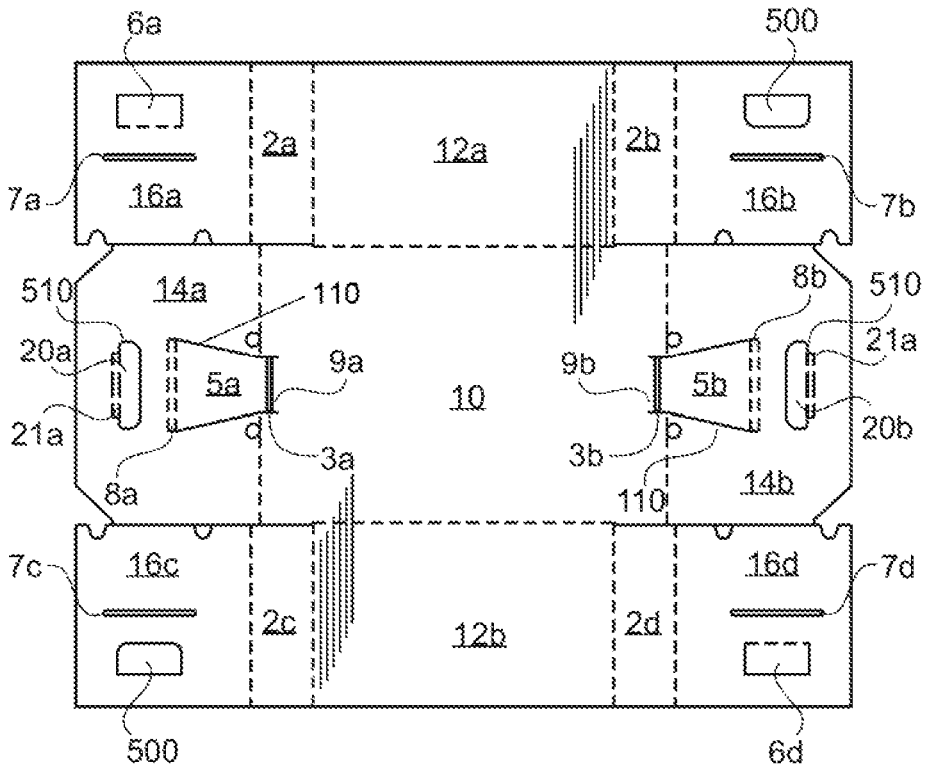
FIG. 1 is a top view of an embodiment of the container of the present invention, the container being shown in a flat configuration.
Figure 2:
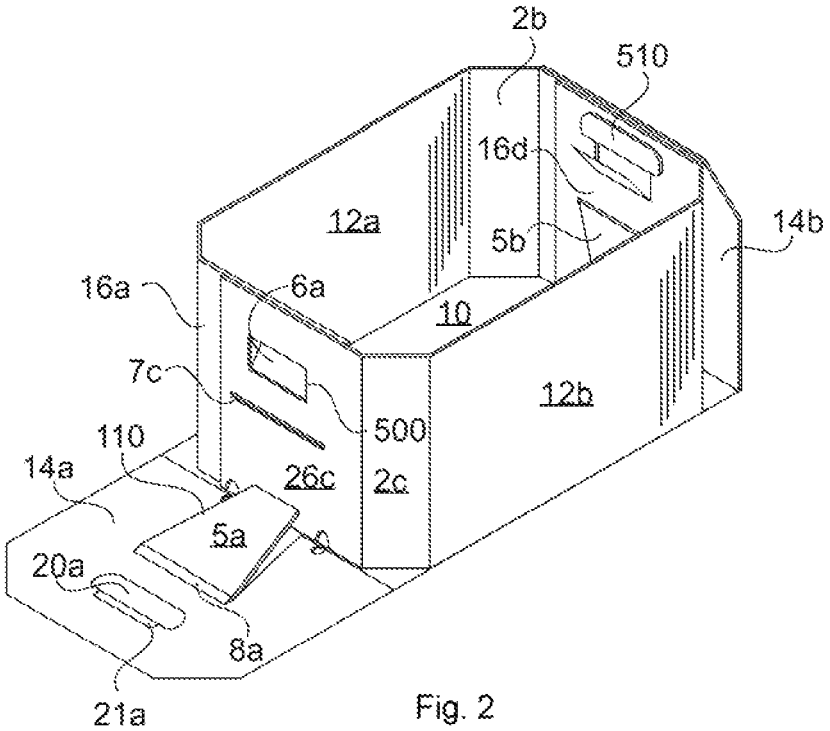
FIG. 2 is a perspective view of the container of FIG. 1, the container being shown in an intermediate configuration between the flat configuration and a three-dimensional configuration, a tab member of the container also being shown in an intermediate configuration between a stowed configuration and a deployed configuration.
Figure 3:
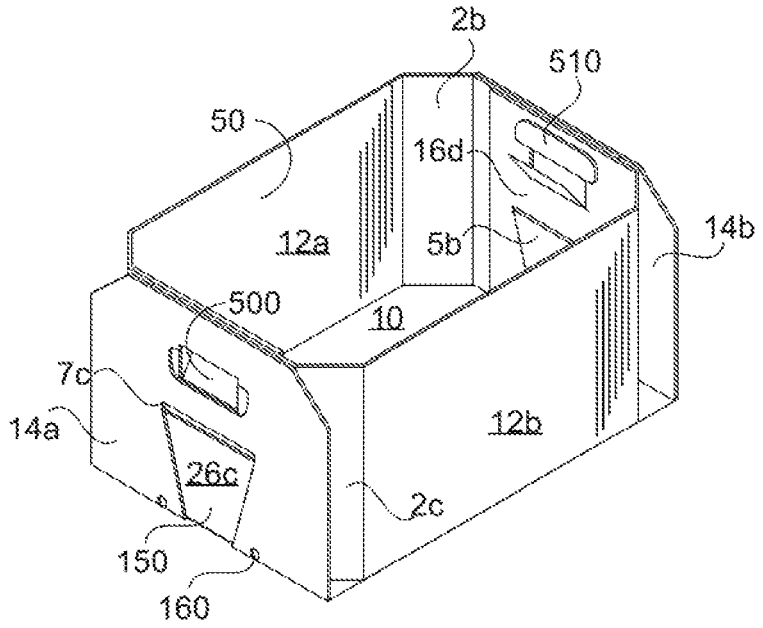
FIG. 3 is a perspective view of the container of FIG. 1, the container being shown in a three-dimensional configuration.
Figure 4:
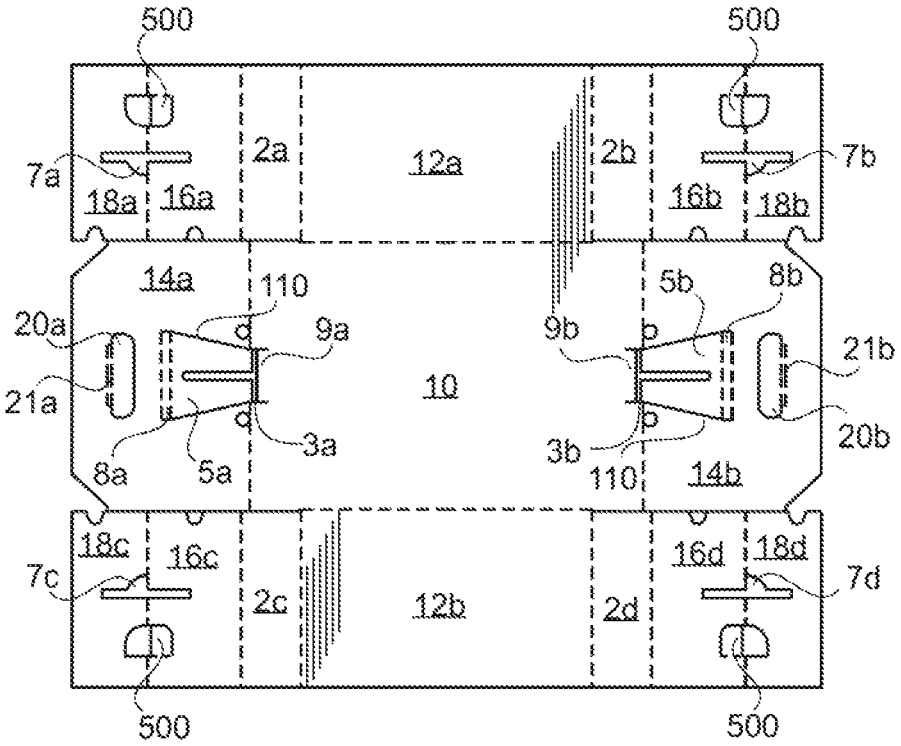
FIG. 4 is a top view of an embodiment of the container of the present invention, the container having a plurality of post panels and being shown in a flat configuration.
Figure 5:
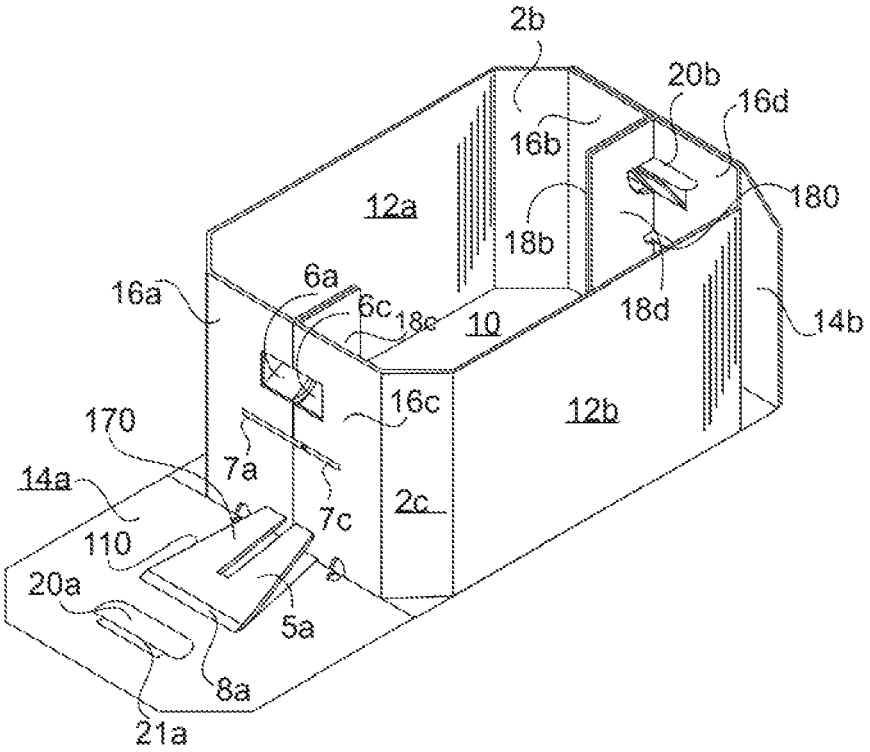
FIG. 5 is a perspective view of the container of FIG. 4, the container being shown in an intermediate configuration between the flat configuration and a three-dimensional configuration, a tab member of the container also being shown in an intermediate configuration between a stowed configuration and a deployed configuration.
Figure 7:
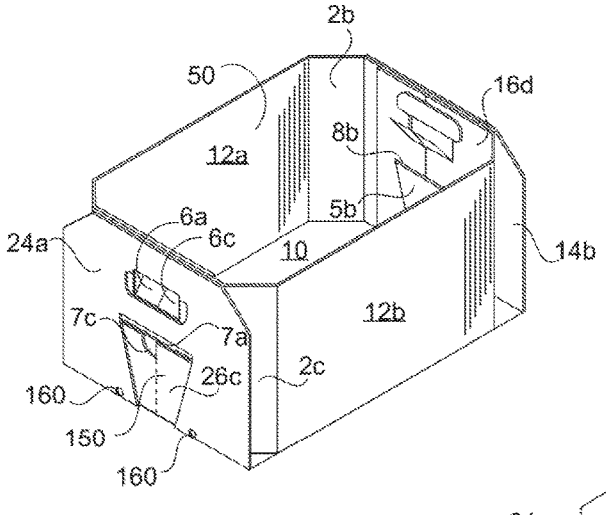
FIG. 7 is a perspective view of the container of FIG. 4, the container being shown in a three-dimensional configuration with the post panels being generally parallel with the end panels.
Figure 6:
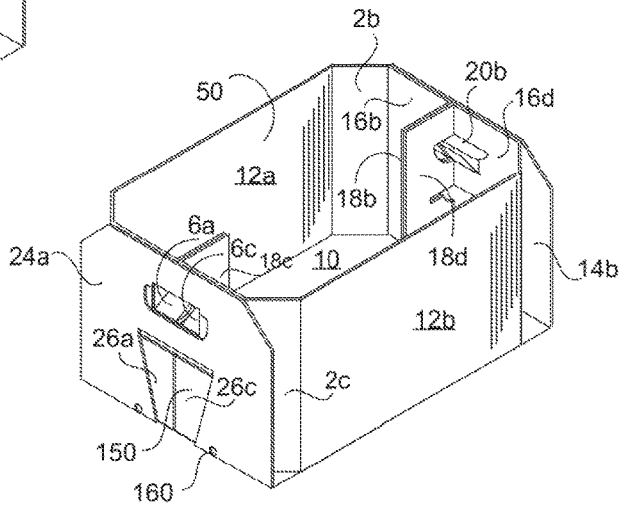
FIG. 6 is a perspective view of the container of FIG. 4, the container being shown in a three-dimensional configuration with the post panels being generally perpendicular to the end panels.

Referring to FIG. 1, a preferred embodiment of a flat pattern of the present invention includes a bottom panel 10, side panels 12*a*, 12*b* extending outward from opposed sides of the bottom panel 10, and end panels 14*a*, 14*b* extending outward from opposed ends of the bottom panel 10. In some embodiments, the side panels extend substantially between each end of the bottom panel and the end panels extend substantially between each side of the bottom panel such that the panels form a four-sided container when the panels are folded into a three-dimensional configuration. In other embodiments, one or more panel is truncated such that it does not extend to one or more edge of the bottom panel and/or one or more panel is extended so that it extends beyond one or more edge of the bottom panel. For example, FIGS. 1-3 show an embodiment that includes a corner panel 2*a*-2*d* extending from each end of two truncated side panels such that the panels form an eight-sided container when the panels are folded into a three-dimensional configuration. It will be appreciated that other embodiments of the present invention, including embodiments shown in FIGS. 10, 11A, 12A, 13A, 14, 15, 16A, 17, 18A, 19, 20, 21A, and 22A, include different flat-pattern configurations so as to create three-dimensional containers having various shapes and sizes.

Referring to FIGS. 1, 11A, 13A, and 21A, some embodiments of a flat pattern of the present invention further includes at least one side folding panel 16*a*-16*d* extending either directly or indirectly from a side panel 12. For example, some embodiments of a four-sided container include a side folding panel 16*a*-16*d* extending directly from each end of two side panels. As another example, FIGS. 1-3 show an embodiment of an eight-sided container that includes a side folding panel 16*a*-16*d* extending from each corner panel 2*a*-2*d* such that the side folding panels 16*a*-16*d* each indirectly extend from an end of a truncated side panel. As yet additional examples, FIGS. 18A-18E, 19, and 20 show various embodiments of eight-sided containers that include corner panels 2*a*-2*d* extending between side 12*a*, 12*b* and end 14*a*, 14*b* panels. It will be appreciated that other embodiments of the present invention include different flat-pattern configurations having different configurations of folding panels, such as one or more bottom folding panel, top folding panel, and/or end folding panel instead of and/or in addition to one or more side folding panel.

In some embodiments of containers of the present invention, such as the eight-sided container embodiment shown in FIGS. 2 and 3, each side panel, side folding panel, and end panel is generally perpendicular to the bottom panel such that when the bottom panel is horizontal, the other panels extend vertically upward so as to define an interior area 50 for holding items. In some embodiments, each side folding panel 16*a*-16*d* is folded against a respective side folding panel such that a tab slot 7*a*-7*d* of each side folding panel 16*a*-16*d* aligns with a tab slot 7*a*-7*d* of the respective side folding panel 16*a*-16*d* that it is folded against. In other embodiments, each end panel is folded against one or more side folding panel so that so that a tab member 110 of the end panel can be received by each tab slot 7*a*-7*d* of the side folding panels 16*a*-16*d* such that the container is locked in a three-dimensional configuration with a reverse tuck lock feature. In some embodiments, the tab member 110 includes a first portion 8*a*, 8*b* that is configured to be received by one or more tab slot 7*a*-7*d* and a second portion 5*a*, 5*b* that extends beyond the one or more tab slot 7*a*-7*d* into an interior area 50 of the container. In other embodiments, one or more panel, such as the bottom panel 10 defines a terminal slot 3*a*, 3*b* that is configured to receive a portion of the tab member 110 so as to secure the tab member in a locked configuration. In some such embodiments, the panel also includes a tuck flange 9*a*, 9*b* adjacent to the terminal slot 3*a*, 3*b*. In some such embodiments, the tuck flange 9*a*, 9*b* is configured to allow the tab member to move in and out of the terminal slot and/or to retain the tab member within the terminal slot. In some embodiments, the container includes indicia 26*a*, 26*c* so as to provide an indication that the tab member has been inserted into the tab slot.

Although many of the containers of the present invention include a bottom wall, opposed side walls, and opposed end walls extending at least partially between opposed side walls so as to define an interior area 50 that is only open on the top, other containers are open in a plurality of directions. For instance, FIGS. 14 and 15 each show embodiments of flat patterns having a single side panel and a single end panel extending from a single bottom panel. Although not shown in a three-dimensional configuration, it is known in the art that folding either of such flat pattern into a three-dimensional configuration would result in container defining an interior area that is open on three sides. Such containers can be utilized as stand-alone containers, as spacers and/or dividers within another container, and/or as corner reinforcement for another container. For simplicity, each such embodiment, regardless of how it is used, is referred to herein as a container.

Figure 8:
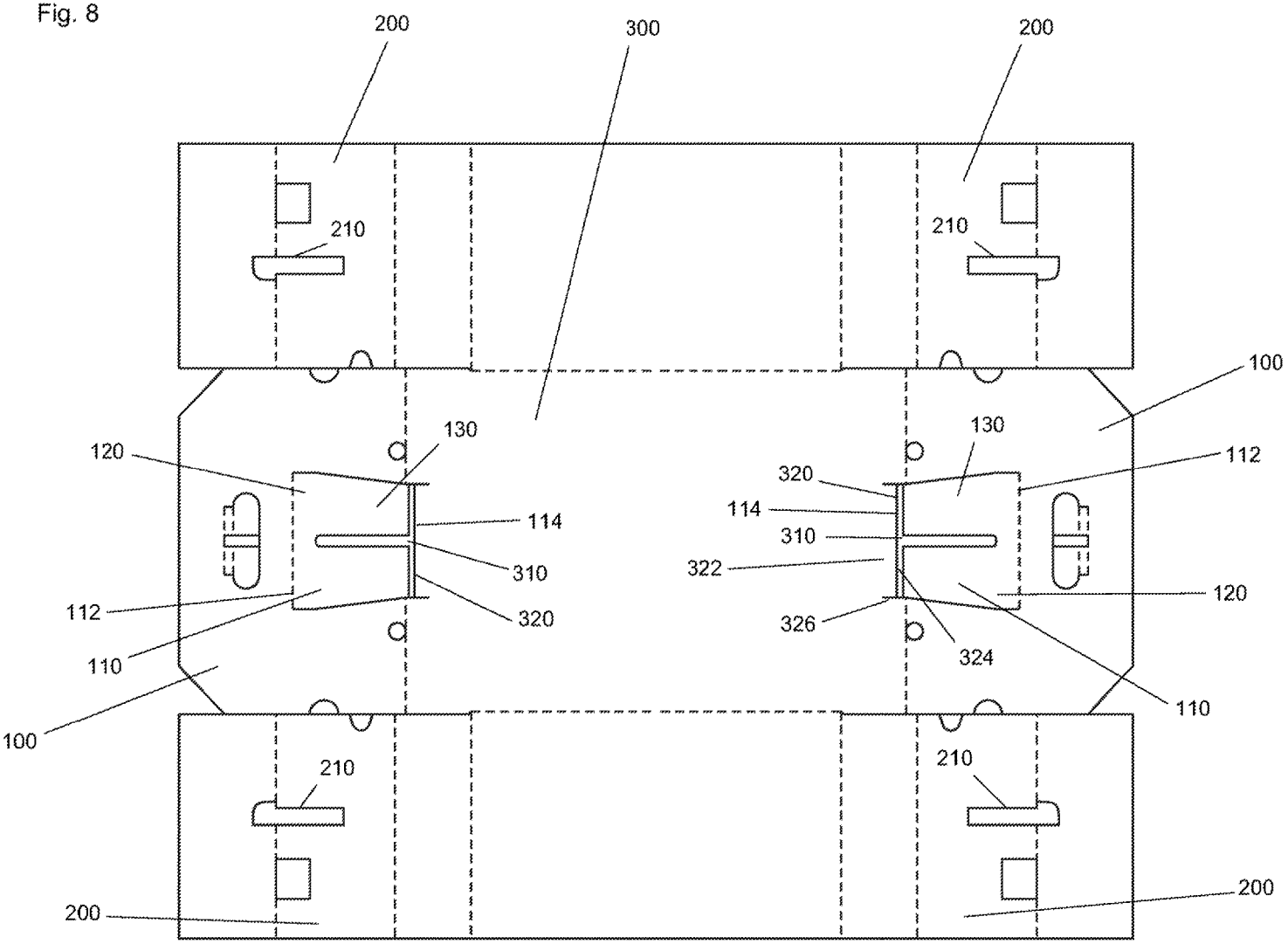
FIG. 8 is a top view of an embodiment of the container of the present invention, the container being shown in a flat configuration.
Figure 9:
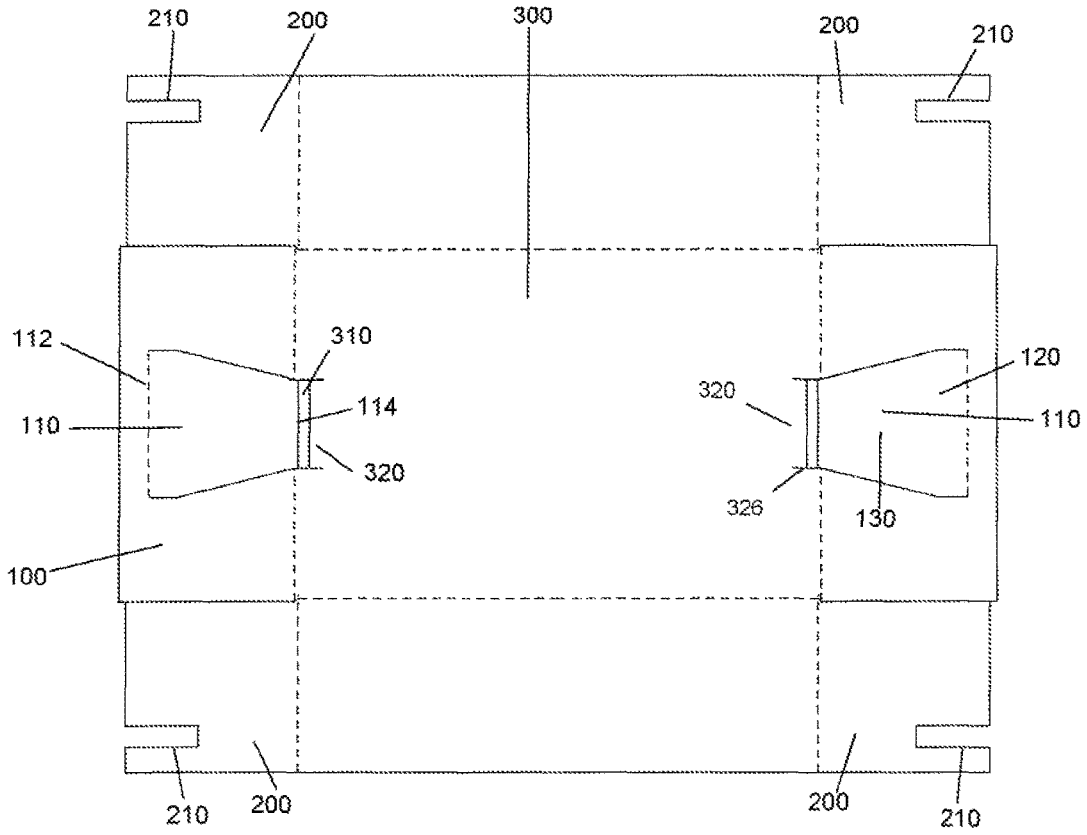
FIG. 9 is a top view of an embodiment of the container of the present invention, the container being shown in a flat configuration.
Figure 10:
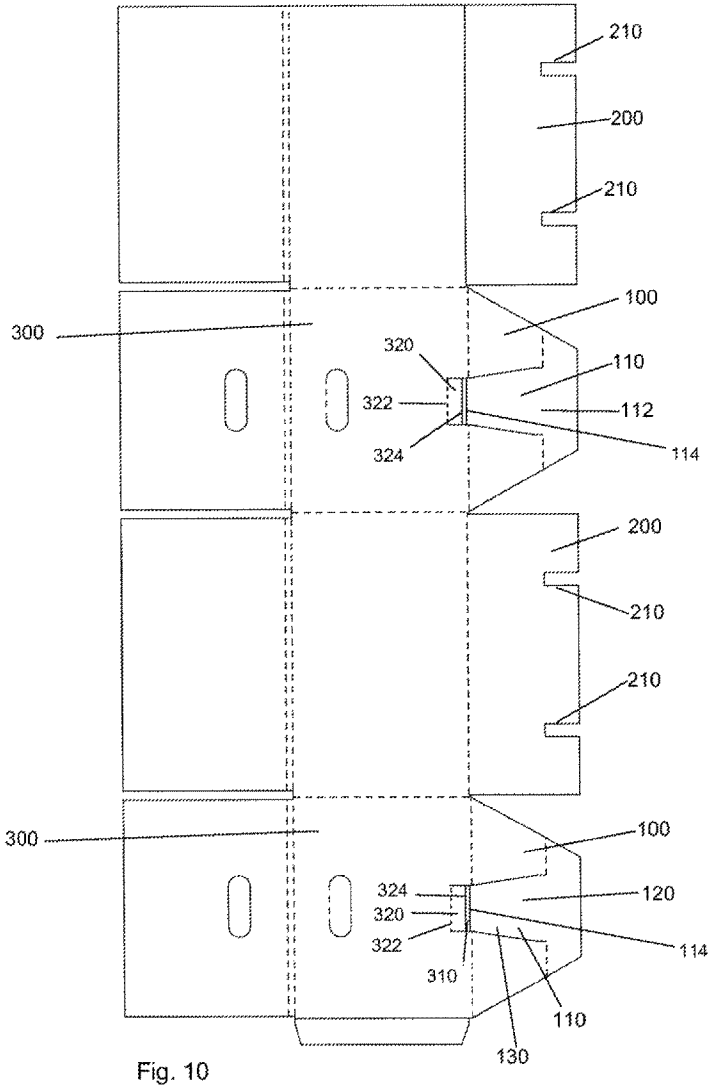
FIG. 10 is a top view of an embodiment of the container of the present invention, the container being shown in a flat configuration.
Figure 11A:
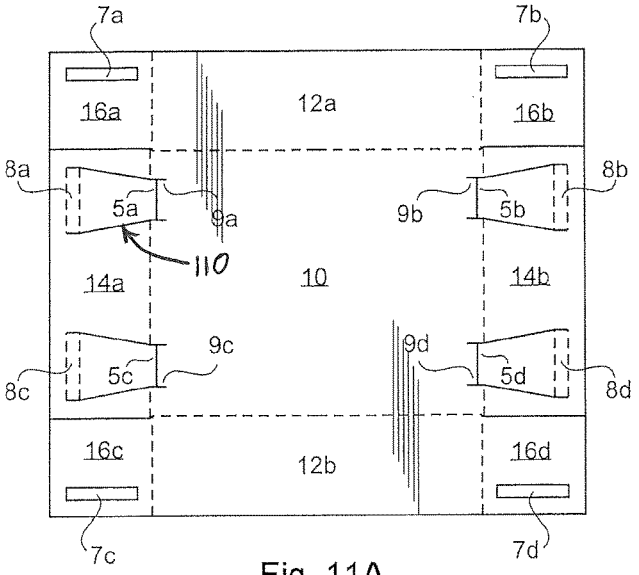
FIG. 11*a* is a top view of an embodiment of the container of the present invention, the container being shown in a flat configuration.
Figure 11B:
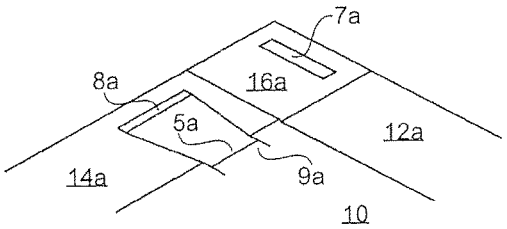
FIG. 11*b* is a partial view of a portion of the container of FIG. 11*a*, the container being in a flat configuration.
Figure 11C:
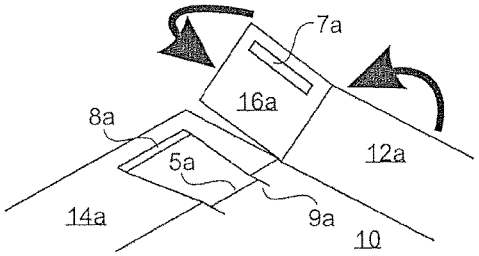
FIG. 11*c* is a partial view of a portion of the container of FIG. 11*a*, the container being in an intermediate configuration, the figure showing arrows indicating how a side folding panel and a side panel are folded.
Figure 11D:
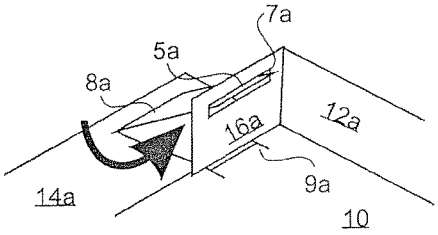
FIG. 11*d* is a partial view of a portion of the container of FIG. 11*a*, the container being in an intermediate configuration, the figure showing an arrow indicating how a tab member is folded so that it can be aligned with a corresponding tab slot.
Figure 11E:
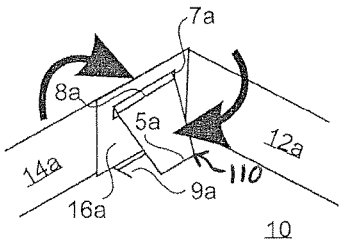
FIG. 11*e* is a partial view of a portion of the container of FIG. 11*a*, the container being in an intermediate configuration, the figure showing arrows indicating how an end panel and a tab member are folded to move the container to a three-dimensional configuration.
Figure 11F:
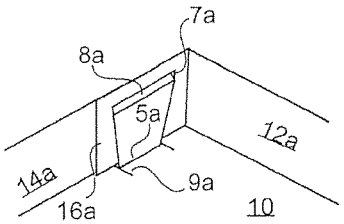
FIG. 11*f* is a partial view of a portion of the container of FIG. 11*a*, the container being in a three-dimensional configuration.
Figure 12A:
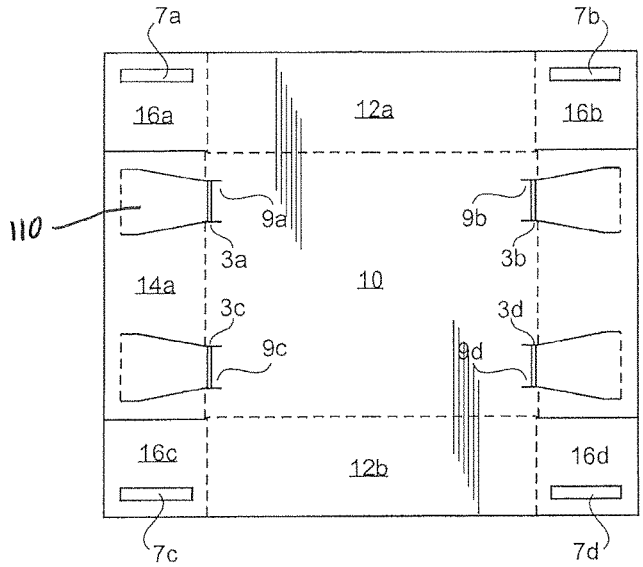
FIG. 12*a* is a top view of an embodiment of the container of the present invention, the container being shown in a flat configuration.
Figure 12B:
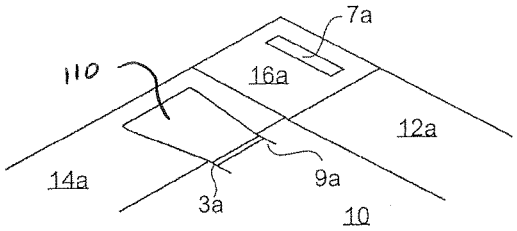
FIG. 12*b* is a partial view of a portion of the container of FIG. 12*a*, the container being in a flat configuration.
Figure 12C:
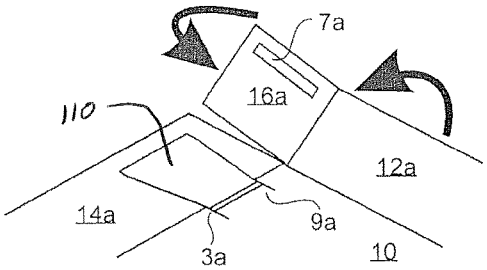
FIG. 12*c* is a partial view of a portion of the container of FIG. 12*a*, the container being in an intermediate configuration, the figure showing arrows indicating how a side folding panel and a side panel are folded.
Figure 12D:
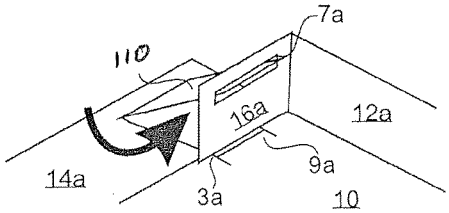
FIG. 12*d* is a partial view of a portion of the container of FIG. 12*a*, the container being in an intermediate configuration, the figure showing an arrow indicating how a tab member is folded so that it can be aligned with a corresponding tab slot.
Figure 12E:
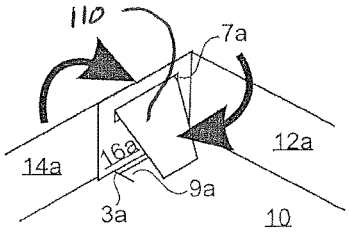
FIG. 12*e* is a partial view of a portion of the container of FIG. 12*a*, the container being in an intermediate configuration, the figure showing arrows indicating how an end panel and a tab member are folded to move the container to a three-dimensional configuration.
Figure 12F:
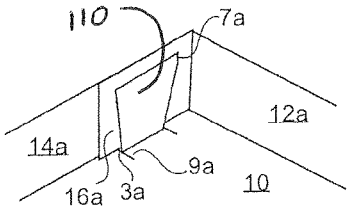
FIG. 12*f* is a partial view of a portion of the container of FIG. 12*a*, the container being in a three-dimensional configuration.
Figure 13A:
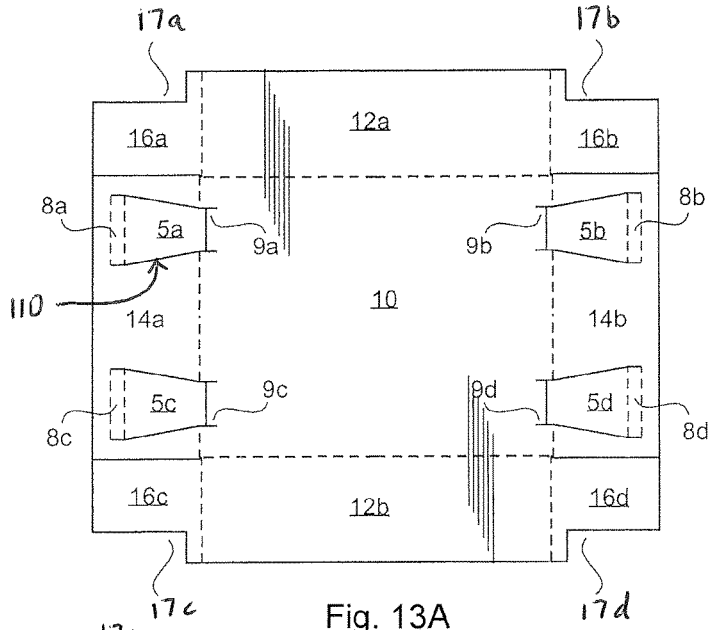
FIG. 13*a* is a top view of an embodiment of the container of the present invention, the container being shown in a flat configuration.
Figure 13B:
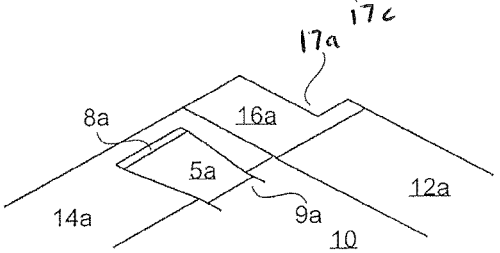
FIG. 13*b* is a partial view of a portion of the container of FIG. 13*a*, the container being in a flat configuration.
Figure 13C:
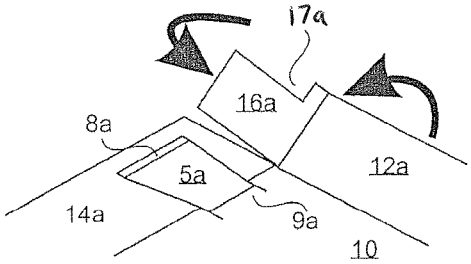
FIG. 13*c* is a partial view of a portion of the container of FIG. 13*a*, the container being in an intermediate configuration, the figure showing arrows indicating how a side folding panel and a side panel are folded.
Figure 13D:
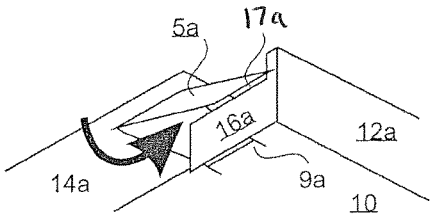
FIG. 13*d* is a partial view of a portion of the container of FIG. 13*a*, the container being in an intermediate configuration, the figure showing an arrow indicating how a tab member is folded so that it can be aligned with an edge profile of a corresponding side folding panel.
Figure 13E:
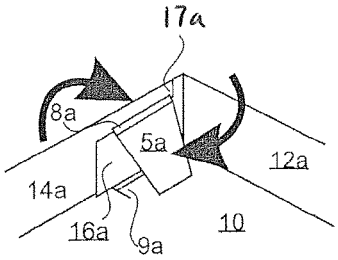
FIG. 13*e* is a partial view of a portion of the container of FIG. 13*a*, the container being in an intermediate configuration, the figure showing arrows indicating how an end panel and a tab member are folded to move the container to a three-dimensional configuration.
Figure 13F:
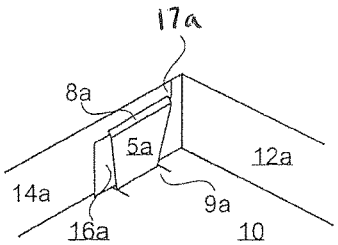
FIG. 13*f* is a partial view of a portion of the container of FIG. 13*a*, the container being in a three-dimensional configuration.
Figure 14:
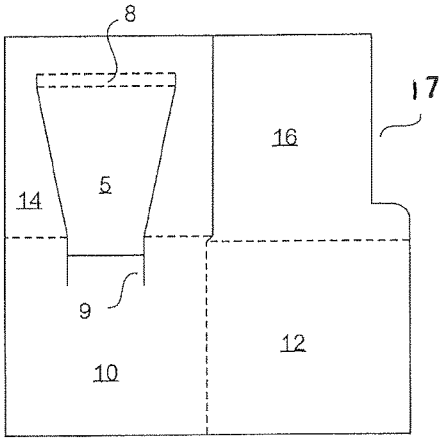
FIG. 14 is a top view of an embodiment of the container of the present invention, the container being shown in a flat configuration.
Figure 15:
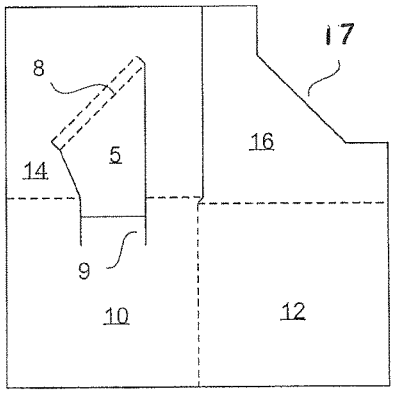
FIG. 15 is a top view of an embodiment of the container of the present invention, the container being shown in a flat configuration.
Figure 16A:
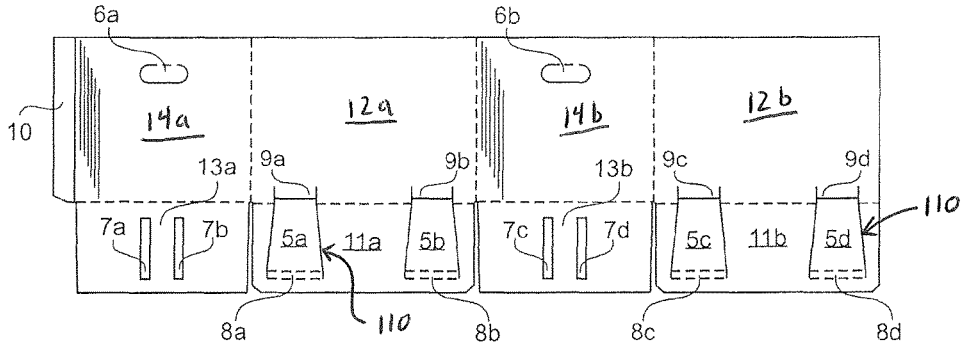
FIG. 16*a* is a top view of an embodiment of the container of the present invention, the container being shown in a flat configuration.
Figure 16B:
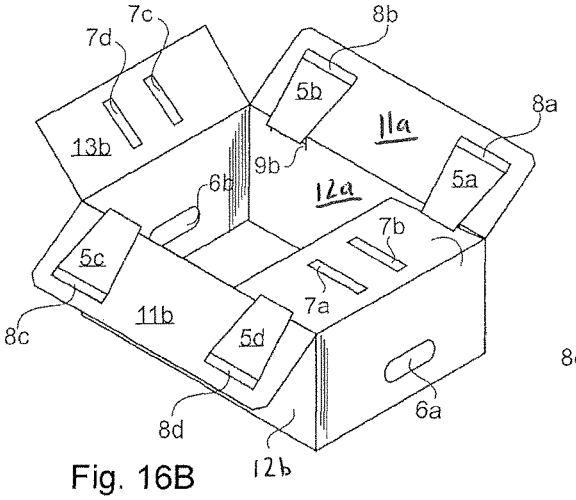
FIG. 16*b* is a bottom isometric view of the container of FIG. 16*a*, the container being in an intermediate configuration with tab members being displaced from corresponding tab slots.
Figure 16C:
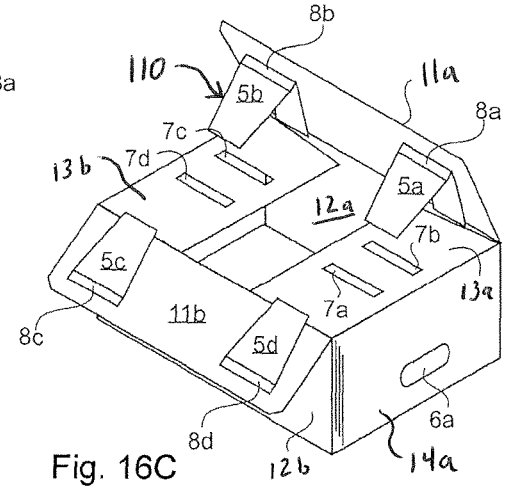
FIG. 16*c* is a bottom isometric view of the container of FIG. 16*a*, the container being in an intermediate configuration with some tab members being positioned in close proximity to corresponding tab slots and other tab members being displaced from corresponding tab slots.
Figure 16D:
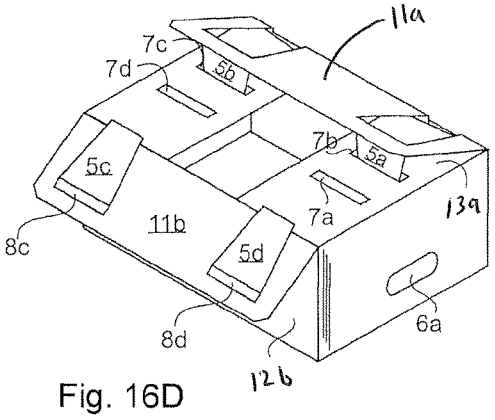
FIG. 16*d* is a bottom isometric view of the container of FIG. 16*a*, the container being in an intermediate configuration with some tab members being partially received by corresponding tab slots and other tab members being displaced from corresponding tab slots.
Figure 16E:
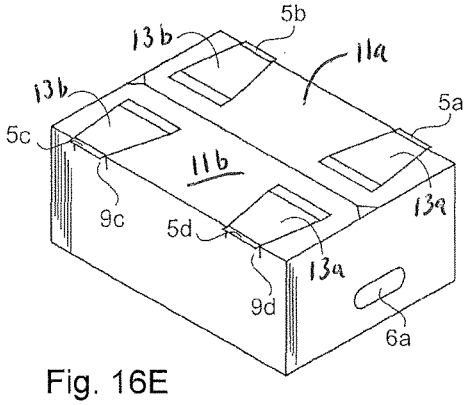
FIG. 16*e* is a bottom isometric view of the container of FIG. 16*a*, the container being in an intermediate configuration with each tab member being fully received by each corresponding tab slot.
Figure 16F:
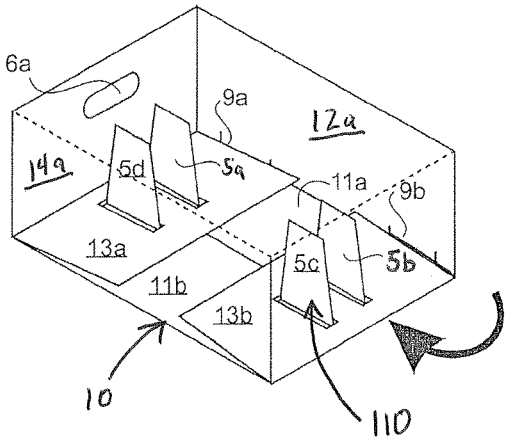
FIG. 16*f* is a top isometric view of the container of FIG. 16*a* with an end panel and a side panel being rendered transparent so that features within the container are more readily apparent, the container being in an intermediate configuration with each tab member being fully received by each corresponding tab slot.
Figure 16G:
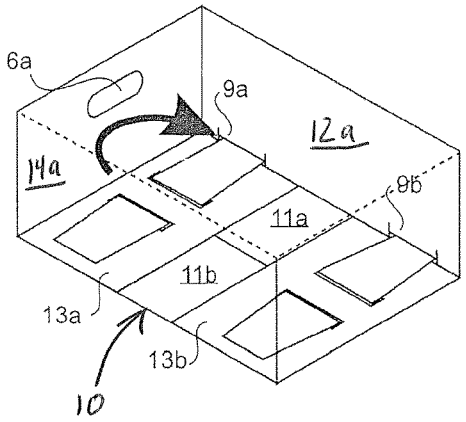
FIG. 16*g* is a top isometric view of the container of FIG. 16*a* with an end panel and a side panel being rendered transparent so that features within the container are more readily apparent, the container being in a three-dimensional configuration.
Figure 17:
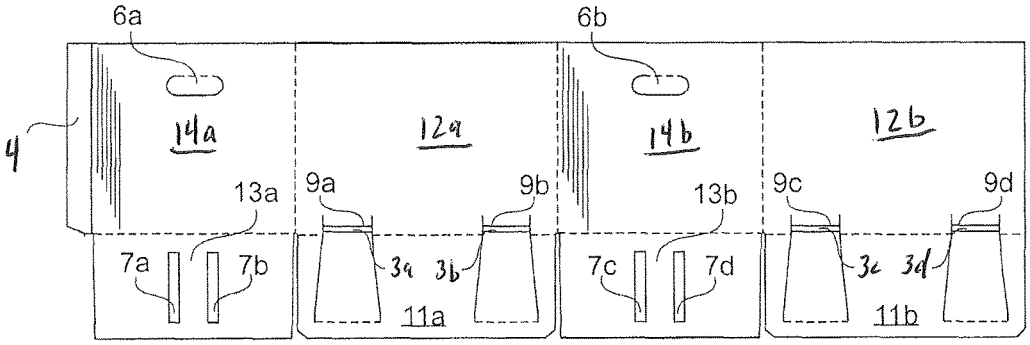
FIG. 17 is a top view of an embodiment of the container of the present invention, the container being shown in a flat configuration.
Figure 18A:
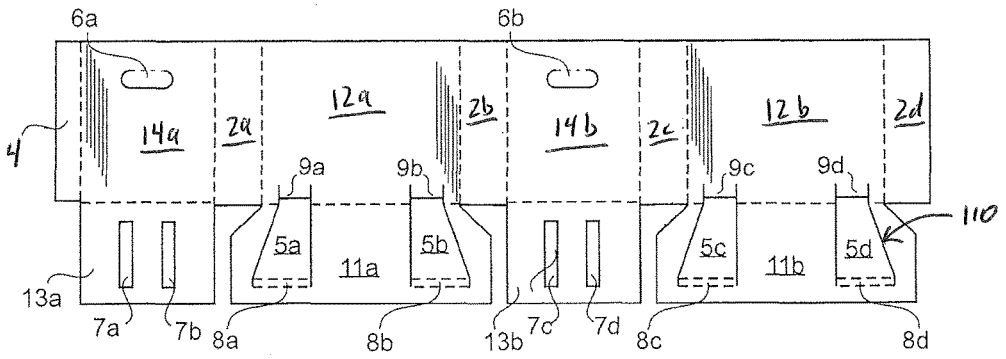
FIG. 18*a* is a top view of an embodiment of the container of the present invention, the container being shown in a flat configuration.
Figure 18B:
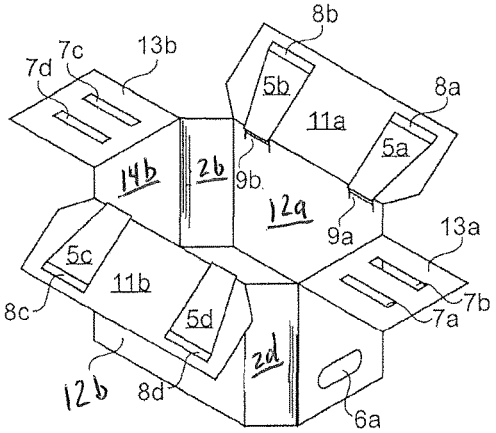
FIG. 18*b* is a bottom isometric view of the container of FIG. 18*a*, the container being in an intermediate configuration with tab members being displaced from corresponding tab slots.
Figure 18C:
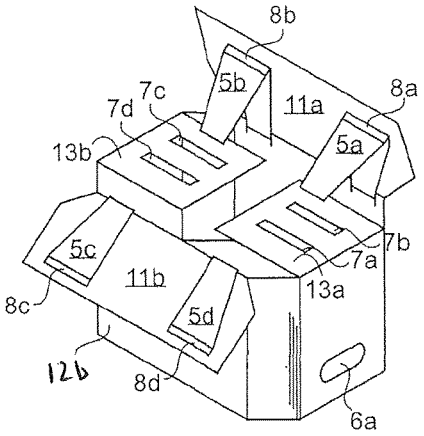
FIG. 18*c* is a bottom isometric view of the container of FIG. 18*a*, the container being in an intermediate configuration with some tab members being positioned in close proximity to corresponding tab slots and other tab members being displaced from corresponding tab slots.
Figure 18D:
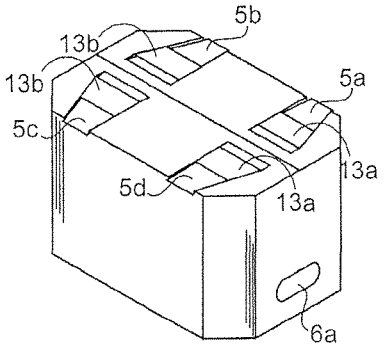
FIG. 18*d* is a bottom isometric view of the container of FIG. 18*a*, the container being in three-dimensional configuration.
Figure 18E:
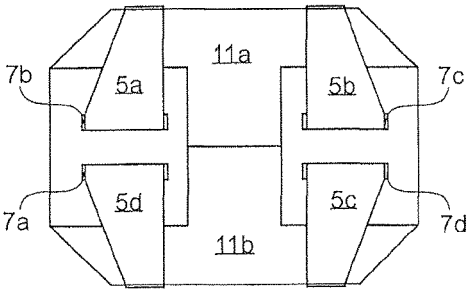
FIG. 18*e* is a top view of the container of FIG. 18*a*, the container being shown in a three-dimensional configuration.
Figure 19:
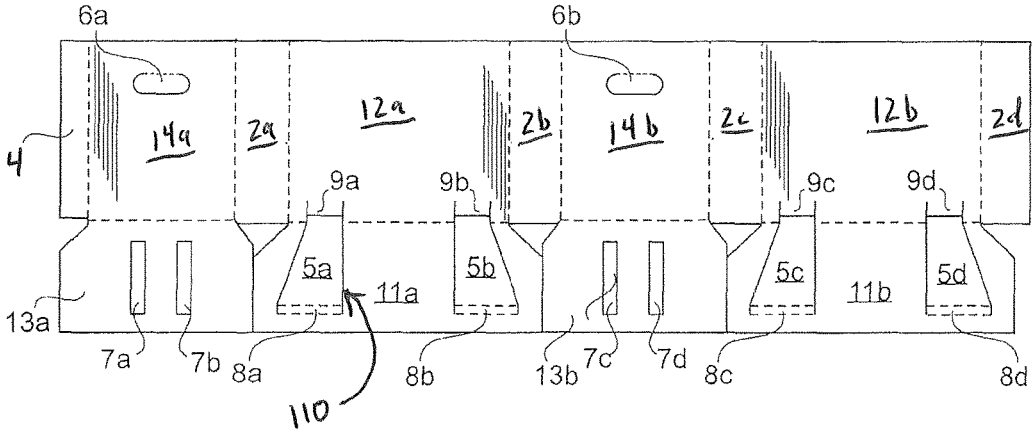
FIG. 19 is a top view of an embodiment of the container of the present invention, the container being shown in a flat configuration.
Figure 20:
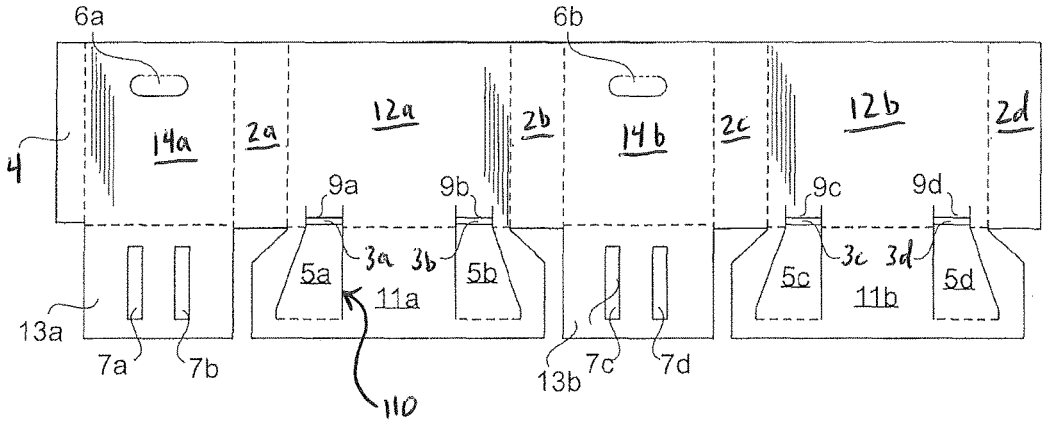
FIG. 20 is a top view of an embodiment of the container of the present invention, the container being shown in a flat configuration.
Figure 21A:
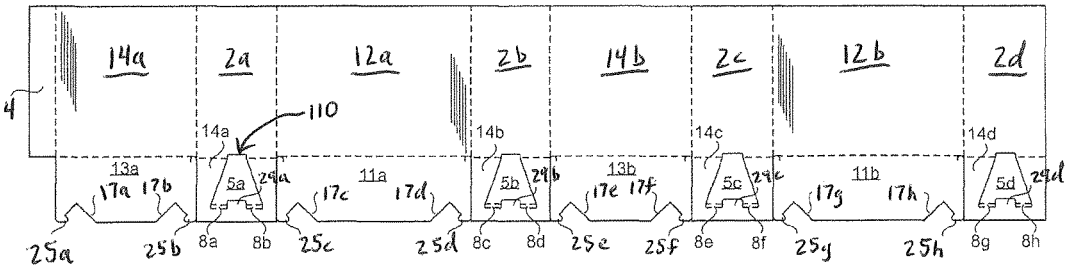
FIG. 21*a* is a top view of an embodiment of the container of the present invention, the container being shown in a flat configuration.
Figure 21B:
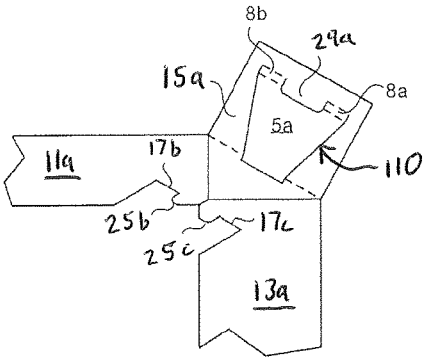
FIG. 21*b* is a partial view of a portion of the container of FIG. 21*a*, the container being in an intermediate configuration in which a tab member is displaced from an edge profile defined by a bottom side panel and a bottom end panel.
Figure 21C:
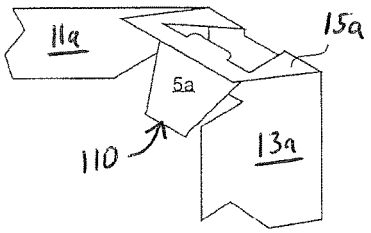
FIG. 21*c* is a partial view of a portion of the container of FIG. 21*a*, the container being in an intermediate configuration in which a tab member is positioned in close proximity to an edge profile defined by a bottom side panel and a bottom end panel.
Figure 21D:
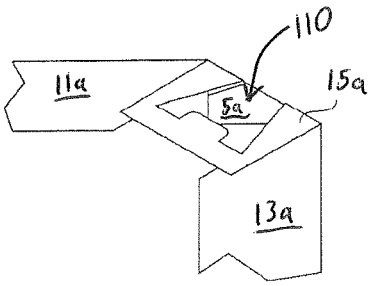
FIG. 21*d* is a partial view of a portion of the container of FIG. 21*a*, the container being in an intermediate configuration in which a tab member is engaged with an edge profile defined by a bottom side panel and a bottom end panel.
Figure 21E:
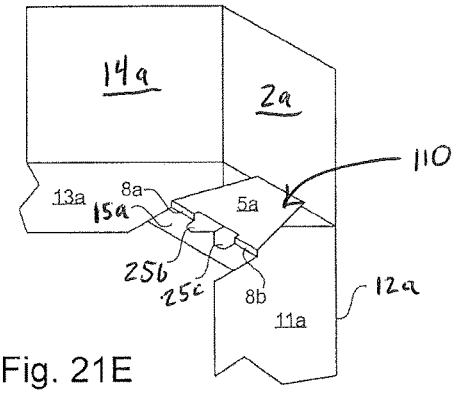
FIG. 21*e* is a partial view of a portion of the container of FIG. 21*a*, the container being in a three-dimensional configuration.
Figure 22A:
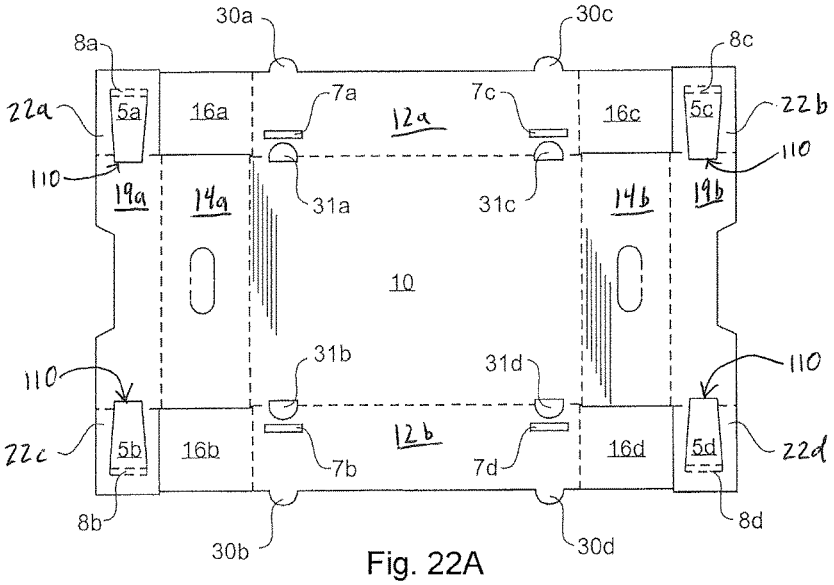
FIG. 22*a* is a top view of an embodiment of the container of the present invention, the container being shown in a flat configuration.
Figure 22B:
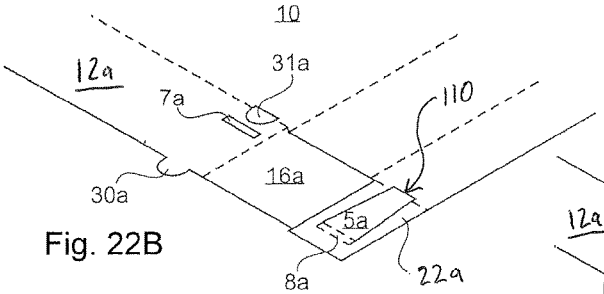
FIG. 22*b* is a partial view of a portion of the container of FIG. 22*a*, the container being in a flat configuration.
Figure 22C:
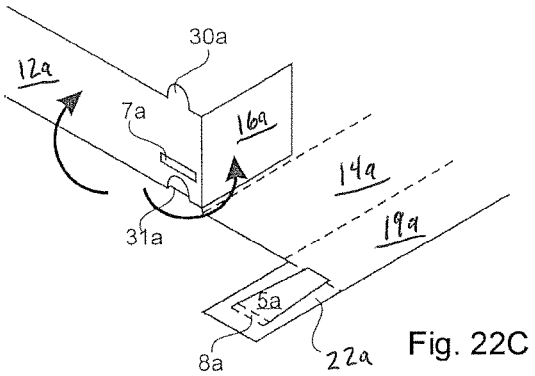
FIG. 22*c* is a partial view of a portion of the container of FIG. 22*a*, the container being in an intermediate configuration, the figure showing arrows indicating how a side folding panel and a side panel are folded.
Figure 22D:
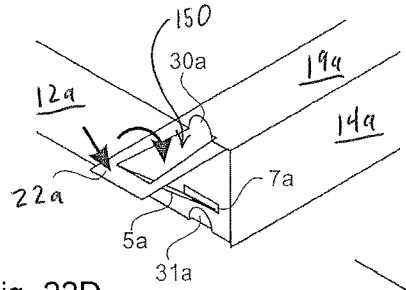
FIG. 22*d* is a partial view of a portion of the container of FIG. 22*a*, the container being in an intermediate configuration, the figure showing arrows indicating how a tab member is folded so that it can be aligned with a corresponding tab slot and how a top folding panel can be folded so as to cause the tab member to be received by the tab slot.
Figure 22E:
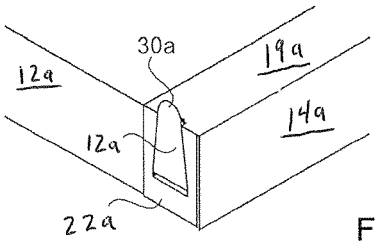
FIG. 22*e* is a partial view of a portion of the container of FIG. 22*a*, the container being in a three-dimensional configuration.

Referring to FIGS. 8-10, a container having a reverse tuck lock feature includes a first panel 100 and a corresponding second panel 200. In some embodiments, the first panel is a primary panel such as an end panel, a side panel, a bottom panel, a top panel, or some other primary panel and the second panel is a folding panel and/or a flange extending from a primary panel other than the first panel. The first panel 100 includes at least part of a tab member 110 and the second panel 200 defines at least part of a corresponding tab slot 210 that is configured to receive the tab member 110 so as to secure the first 100 and second 200 panels in position relative to each other, thereby securing the container in a three-dimensional configuration. It will be appreciated that, in some embodiments, the tab member 110 and/or the tab slot 210 is defined by more than one panel such that each panel is secured relative to the other panels when the tab member 110 is received by the tab slot 210. It will further be appreciated that, in some embodiments, a single tab member is received by more than one tab slot so as to secure the first panel 100 to more than one other panel. It will still further be appreciated that, in other embodiments, a single tab slot receives more than one tab member so as to secure the second panel 200 to more than one other panel.

The tab member 110 includes a proximal end 112 coupled to the first panel 100 and a distal end 114 displaced from the proximal end 112 of the tab member 110. In some embodiments, the tab member 110 includes a first portion 120 extending from the proximal end 112 of the tab member 110 through the tab slot 210 of the second panel 200. In some such embodiments, the first portion 120 of the tab member 110 is substantially perpendicular to the first panel when the tab member 110 is received by the tab slot 210 and the container is in a three-dimensional configuration. In other embodiments, the first portion 120 of the tab member 110 is substantially the same width as the tab slot 210 and has a thickness that is substantially equal to the height of the tab slot 210 such that the tab member 110 substantially fills and/or seals the tab slot 210. In still other embodiments, the first portion 120 of the tab member 110 is sized relative to the tab slot 210 such that when the first portion 120 of the tab member 110 is received by the tab slot 210, the translational movement of the second panel 200 relative to the first panel 100 is prevented or otherwise restricted. In still other embodiments, the second panel 200 rests flat against the first panel 100 when the first portion 120 of the tab member 110 is received by the tab slot 210 and the first portion 120 extends through, but not beyond, the second panel.

In some embodiments, the tab member 110 further includes a second portion 130 extending between the first portion 120 and the distal end 114 of the tab member 110. In some such embodiments, the second portion 130 of the tab member 110 is angled relative to the first portion 120 of the tab member 110 such that the second portion 130 prevents the first portion 120 from sliding out of the tab slot 210 of the second panel 200 so as to prevent the first panel 100 from moving away from the second panel.

In a preferred embodiment, the second portion 130 of the tab member 110 is narrower than the first portion 120 of the tab member and/or the tab slot 210. In this way, the second portion 130 of the tab member 110 is able to more easily pass through the tab slot 210 and/or the risk of damaging the tab member 110 and/or the tab slot 210 is reduced. In some such embodiments, each side of the second portion 130 of the tab member 110 tapers inward such that the second portion 130 of the tab member 110 generally defines a trapezoid.

The tab member 110 is moveable between a stowed configuration and a deployed configuration. In the stowed configuration, the tab member 110 is parallel with the first panel 100 so as to more easily accommodate shipping and storing the container when the container is in a flat configuration. In the deployed configuration, the tab member 110 is angled away from the first panel 100 so as to more easily accommodate inserting the tab member 110 into the tab slot 210 as the container is moved from a flat configuration to a three-dimensional configuration.

The tab member 110 is also moveable between an unlocked configuration and a locked configuration. In the unlocked configuration, the tab member 110 is configured so that it can be removed from the tab slot 210 with relative ease. In the locked configuration, on the other hand, the tab member 110 is configured such that removal of the tab member 110 from the tab slot 210 is prevented or inhibited, thereby enabling the container to be secured in a three-dimensional configuration. In some embodiments, the first portion 120 of the tab member 110 is substantially perpendicular to the first 100 and second 200 panels and the second portion 130 of the tab member is angled away from the first portion 120 when the tab member is in the locked configuration. In some such embodiments, the second portion 130 of the tab member 110 runs substantially parallel with and/or rests substantially against the second panel 200 when the tab member 110 is in the locked configuration.

In some embodiments, the container includes a third panel 300 that defines a terminal slot 310 that is configured to receive the distal end 114 of the tab member 110 when the container is in the three-dimensional configuration and the tab member 110 is in the locked configuration. In some such embodiments, the third panel includes a tuck flange 320 that is movable between an open configuration and a closed configuration. In the open configuration, the tuck flange 320 allows the tab member 110 to move to the locked configuration by rotating the distal end 114 of the tab member 110 past the tuck flange 320 and into the terminal slot 310. In the closed configuration, the tuck flange 320 retains the tab member 110 in the locked configuration by retaining the distal end 114 of the tab member 110 in the terminal slot 310.

In some embodiments, the tuck flange 320 includes a proximal end 322 hingedly coupled to the third panel 300 and a distal end 324 displaced from the proximal end 322 of the tuck flange 320. In some such embodiments, the distal end 324 of the tuck flange defines an edge of the terminal slot 310 when the tuck flange 320 is in the closed configuration. In other embodiments, the sides of the tuck flange 320 are defined by slits in the third panel 300, each slit extending from the proximal end 322 of the tuck flange 320 to the distal end 324 of the tuck flange 320 so as to allow the tuck flange 320 to rotate relative to the rest of the third panel 300. In some such embodiments, the slit 326 is narrow enough such that the edge of the tuck flange 320 interfaces with the third panel 300 in such a way that the tuck flange 320 is held in the closed configuration. In other such embodiments, the proximal end 322 of the tuck flange 320 is coupled to the third panel 300 in such a way that the tuck flange 320 is biased towards the closed configuration or is otherwise configured so as to hold the tuck flange 320 in the closed configuration.

In some embodiments of the present invention, the terminal slot is at least partially defined by the first panel 100 and/or extends to the first panel 100 such that the first panel 100 defines an edge of the terminal slot. In some such embodiments, the tab member 110 extends to the terminal slot 310 when the container is in the flat configuration. In other such embodiments, the tab member 110 extends into the terminal slot 310 when the container is in the flat configuration such that the distal end 114 of the tab member 110 is formed from at least some of the material that is removed from the third panel 300 to define the terminal slot 310. In still other such embodiments, the tab member 110 extends to the tuck flange 320 such that the distal end 114 of the tab member 110 is proximate to the distal end 324 of the tuck flange 320 when the container is in the flat configuration.

Referring to FIGS. 13A-13F, 14, and 15, some embodiments include a first panel defining a tab member 110 and a second panel defining an edge profile 17. In some such embodiments, the first panel is configured to fold against the second panel when the tab member 110 is in a deployed configuration so as to allow the tab member 110 to pass over the edge profile 17 of the second panel in a similar fashion as to how tab member 110 of other embodiments pass over a bottom edge of a tab slot when such tab members 110 of first panels of such other embodiments are being inserted into a tab slot of a second panel of such other embodiments. In some embodiments, the first panel is an end panel 14 and the second panel is a side folding panel 16. It will be appreciated, however, that the first panel can also be side panel, a bottom panel, or a variety of other panels and the second panel can be a corresponding panel such that the first and second panels can be folded against each other when a container is in a three-dimensional configuration and the tab member can be utilized to retain the first and second panels next to each other so as to retain the container in the three-dimensional shape.

Referring to FIGS. 16A-16F, 17, 18A-18E, 19, and 20, some embodiments of the present invention include a bottom panel 10 formed from one or more bottom side panel 11*a*, 11*b* and/or one or more bottom end panel 13*a*, 13*b*. In some such embodiments, a bottom side panel 11*a*, 11*b* extends from a bottom edge of opposed side panels 12*a*, 12*b* such that when such bottom side panels are folded inward towards each other, they form at least part of a bottom panel 10. In other such embodiments, a bottom end panel 13*a*, 13*b* extends from a bottom edge of opposed end panels 14*a*, 14*b* such that when such bottom end panels are folded inward towards each other, they form at least part of a bottom panel 10.

In some embodiments, one or more bottom side panel 11*a*, 11*b* defines at least part of one or more tab member 110 and one or more bottom end panel 13*a*, 13*b* defines at least part of one or more tab slot. In some such embodiments, each tab member 110 is configured to be received by at least one tab slot so as to secure the container in a three-dimensional configuration. In other such embodiments, each tab slot is configured to receive at least one tab member 110 so as to secure the container in a three-dimensional configuration. In still other such embodiments, one or more side panel defines one or more terminal slot and/or one or more tuck flange so as to secure one or more tab member 110 in a locked configuration, thereby securing the container in a three-dimensional configuration. It will be appreciated that in other embodiments one or more bottom side panel 11*a*, 11*b* defines at least part of one or more tab slot and one or more bottom end panel 13*a*, 13*b* defines at least part of one or more tab member 110. It will further be appreciated that in such other embodiments, one or more end panel defines one or more terminal slot and/or one or more tuck flange so as to secure one or more tab member 110 in a locked configuration.

Some embodiments include a first panel defining a tab member 110 and one or more second panel defining at least part of an edge profile 17. In some such embodiments, the first panel is configured to fold against the one or more second panel when the tab member 110 is in a deployed configuration so as to allow the tab member 110 to pass over the edge profile 17 of the one or more second panel in a similar fashion as to how the tab members 110 of other embodiments passes over a bottom edge of a tab slot when such tab members 110 of first panels of such other embodiments are being inserted into tab slots defined by one or more second panel of such other embodiments. In some embodiments, the first panel is a bottom corner panel 15, a second panel is a bottom end panel 13, and an additional second panel is a bottom side panel 11.

Referring to FIGS. 21A-21E, a bottom corner panel 15 extends from a bottom edge of a corner panel 2, a bottom end panel 13 extends from a bottom edge of an end panel 14, a bottom side panel 11 extends from a bottom edge of a side panel 12, and a corner panel 2 extends between the end panel 14 and the side panel 12. In some embodiments, the bottom corner panel 15, the bottom end panel 13, and the bottom side panel 11 can be folded inward and against each other so as to form at least part of a bottom panel of the container and/or a lip for supporting a bottom panel of the container.

Still referring to FIGS. 21A-21E, second panels, such as bottom side panels 11 and/or bottom end panels 13, of some embodiments of the present invention define a protruding member 25 that is configured to engage with a first panel, such as a bottom corner panel, of the container when the tab member 110 is moved away from its stowed configuration. In some such embodiments, the protruding member 25 extends into a void 150 that is defined by the first panel. In other such embodiments, a second panel extends at least partially into a void 150 of the first panel and a protruding member 25 extends from an edge of the second panel away from the void, thereby securing the first panel between the second panel and the protruding member 25 of the second panel. In some such embodiments, the first panel includes a flange member 29 extending into the void 150, the flange member being defined by the first panel when the tab member is folded away from the stowed configuration. In some such embodiments, the flange member 29 extends from an edge of the void 150 that is defined by a proximal end of the tab member 110 and/or is formed from the proximal end of the tab member 110 by folding the rest of the tab member 110 away from the stowed configuration while retaining the flange member 29 in the stowed configuration. In other such embodiments, the flange member 29 of the first panel and the protruding member 25 of the second panel are configured to engage with each other so as to secure the first and second panels together. In still other such embodiments, the corner panel 2 defines all or part of a terminal slot and/or a tuck flange for securing the tab member 110 in a locked configuration, thereby securing the container in a three-dimensional configuration.

Some embodiments of the present invention further include at least part of a top panel. Referring to FIGS. 22A-22E, some such embodiments include a top end panel 19*a*, 19*b* extending from a top edge of opposed end panels 14*a*, 14*b*. In some such embodiments, top folding panels 22*a*-22*d* extend from opposed sides of each top end panel 19*a*, 19*b*. In this way, the top end panels 19*a*, 19*b* are capable of folding up over a top edge of opposed side panels 12*a*, 12*b* and each top folding panel 22*a*-22*d* is capable of folding back over a corresponding side panel 12*a*, 12*b* so as to be secured to the corresponding side panel 12*a*, 12*b*. It will be appreciated that other embodiments include at least one top side panel (not shown) extending from a top edge of a side panel, the top side panel having at least one top folding panel extending therefrom such that the top side panel can be folded over a top edge of one or more end panel and the top folding panel can be folded back over a corresponding end panel so as to be secured to the corresponding end panel.

Still referring to the embodiment shown in FIGS. 22A-22E, each top folding panel 22*a*-22*d* defines a tab member 110 and each side panel defines a plurality of tab slots 7*a*-7*d* for receiving corresponding tab members 110. In some embodiments, at least one panel, such as a side panel, includes one or more alignment tab 30*a*-30*d*. In some such embodiments, each alignment tab 30*a*-30*d* extends from a top edge of a side panel such that as the top end panels are folded over the top edges of the side panels, the alignment tabs are received by respective voids 150 defined by respective top end panels 19*a*, 19*b* and/or respective top folding panels 22*a*-22*d*. In other such embodiments, securing the top folding panels to their respective side panels prevents and/or inhibits the alignment tabs from being removed from their respective voids 150.

In some embodiments, at least one alignment tab 30*a*-30*d* extends vertically above a top surface of a respective top panel 19*a*, 19*b*. In some such embodiments, at least one side panel further defines at least one alignment slot 31*a*-31*d* that is configured to receive a corresponding alignment tab 30*a*-30*d* of another container. In this way, a first container having an alignment slot defined by a bottom portion of a side panel can be stacked on top of a second container having a corresponding alignment tab with the corresponding alignment tab of the second container being received by the alignment slot of the first container for secure engagement and/or positive alignment.

The present invention also pertains to a method of making a container having a reverse tuck feature. In some embodiments, the method includes cutting at least part of a profile of at least one tab member 110 in a first panel 100 such that the first panel 100 defines at least part of a tab member 110 that is hingedly coupled to the first panel 100. In some such embodiments, the first panel 100 is weakened at a proximal end 112 of the tab member 110 so as to enable the tab member 110 to rotate between a stowed configuration and a deployed configuration. In other such embodiments, the tab member 110 is weakened between a first portion 120 and a second portion 130 so as to enable the tab member 110 to move between an unlocked configuration and a locked configuration. In still other such embodiments, the tab member is cut so as to define a flange member 29 extending from the first panel 100 at or near a proximal end 112 of the tab member 110.

In some embodiments, the method also includes cutting at least part of a profile of at least one engagement feature in a second panel 200. In some embodiments, the engagement feature is a tab slot 210 and the second panel 200 defines at least part of a tab slot 210 that is configured to receive the tab member 110. In other embodiments, the engagement feature is an edge profile that is configured so as to allow the tab member 110 to fold over the edge profile. In still other embodiments, the engagement feature is a a protruding member 25, that is configured to engage with the first panel 100 so as to further secure the first panel 100 to the second panel 200. In still other embodiments, the engagement feature is an alignment tab 30.

In some embodiments, the method further includes cutting a second panel such that it includes one or more alignment tab 30 and/or alignment slot 31. In some such embodiments, the alignment tab 30 is configured to be received by a void 150 defined by the first panel 100 and/or by a fourth panel 19 extending from the first panel 100. In other such embodiments, the alignment slot 31 of a first container is configured to receive an alignment tab 30 of another container when the containers are stacked on top of each other.

In some embodiments, the method also includes marking at least a portion of an outer surface of the second panel 200 with indicia. At least one purpose for marking the second panel 200 is to provide an indication when the tab member is received by the tab slot and/or when the container is secured in a three-dimensional configuration.

In a preferred embodiment, a third panel 300 extends from a proximal edge 102 of the first panel 100. In some embodiments, the third panel 300 is cut to define an engagement feature, such as a terminal slot 310 and/or a tuck flange 320. In some such embodiments, cutting the engagement feature in the third panel 300 coincides with cutting a distal end 114 of the tab member 110 such that the tab member 110 is cut from the first panel 100 and the third panel 300. In this way, the distal end 114 of the tab member 110 is sized to engage snugly with the engagement feature. In some embodiments, the cutting step includes cutting two slits in the third panel, each slit extending away from a terminal slot 310 towards a proximal end 322 of a tuck flange 320. In some such embodiments, the third panel 300 is weakened at the proximal end 322 of the tuck flange 320 so as to enable the tuck flange 320 to rotate between an open configuration and a closed configuration.

The present invention also includes a method of moving the container from a flat configuration to a three-dimensional configuration. The method includes moving the tab member 110 from the stowed configuration to the deployed configuration such as by folding the tab member 110 away from the first panel 100. In some embodiments, moving the tab member 110 to the deployed configuration causes the first panel 100 to define a void 150. In some such embodiments, the void 150 extends from a proximal end 112 of the tab member 110 to a proximal edge 102 of the first panel 100. In other embodiments, the void 150 extends beyond the proximal end 112 of the tab member 110 and into an adjacent third panel 300.

The method further includes moving the first 100 and second 200 panels relative to each other so as to enable the tab member 110 and/or the void 150 of the first panel to engage with an engagement feature of the second panel. In some such embodiments, the panels are then moved against each other so as to further engage the tab member 110 and/or the void 150 of the first panel 100 with the engagement feature of the second panel. In some embodiments, this process causes the first 100 and second 200 panels to be perpendicular to a third panel 300. In other embodiments, this process results in the container defining an interior area 50 for holding items.

In some embodiments, the engagement feature of the second panel is a tab slot 210 and/or an edge profile 17 that is configured to engage with a tab member 110 of the first panel. In other embodiments, the engagement feature of the second panel is an alignment tab and/or a protruding member 25 that is configured to engage with a void 150 of the first panel 100. In some such embodiments, one or more protruding member 25 of one or more second panel 200 extends past a void 150 of a first panel 100 so as to engage with the first panel 100. In other such embodiments, one or more protruding member 25 of one or more second panel 200 extends past the void 150 of the first panel 100 so as to engage with a flange member 29 of the first panel.

In some embodiments, the method further includes moving the tab member 110 from an unlocked configuration to a locked configuration so as to secure the first panel 100 to the second panel 200, thereby securing the container in the three-dimensional configuration. In some such embodiments, the items themselves exert a force on the tab member 110 so as to move the tab member to the locked configuration. In other such embodiments, a user moves the tab member to the locked configuration. In some such embodiments, a distal end 114 of the tab member 110 is inserted into a terminal slot 310 to secure the tab member 110 in the locked configuration. In some embodiments, the items exert a force on the tab member 110 so as to secure the tab member 110 in the locked configuration. As a result, in some embodiments, filling the container with items when the container is in a three-dimensional configuration actually helps to retain the container in the three-dimensional configuration.

In some embodiments, the method still further includes moving a tuck flange 320 from a closed configuration to an open configuration so as to allow the distal end 114 of the tab member 110 to more easily move into the terminal slot 310. The tuck flange 320 is then moved back to the closed configuration so as to secure the distal end 114 of the tab member 110 in the terminal slot 310, thereby securing the tab member 110 in the locked configuration. In some such embodiments, items positioned within the interior area 50 of the container bias the tab member 110 toward the locked configuration such that even if the tuck flange 320 is moved to the open configuration when the items are placed in the container, the tab member 110 will remain in the locked configuration.

Some embodiments of the present invention also include a method of moving the tab member 110 from the locked configuration to the unlocked configuration. In some embodiments, the method includes moving the tuck flange 320 to an open configuration so as to allow the distal end 114 of the tab member 110 to be removed from the terminal slot 310. In this way, the structural integrity of the tab member is preserved.

The present invention also includes a method of moving a container from a three-dimensional configuration to a flat configuration. The method includes removing a tab member 110 from a tab slot 210 so as to allow first 100 and second 200 panels to be folded flat relative to each other. The tab member 110 is then moved to a stowed configuration. In some embodiments, such a step requires the tab member 110 to be received by a void 150 of the first panel 100.

In use, the container of the present invention is quickly and easily movable between a flat configuration and a three-dimensional configuration while maintaining the structural integrity of the container. For instance, bonding agents are not required. Consequently, damage associated with removing bonding agents and/or failure of bonding agents is avoided. Furthermore, some embodiments of the present invention include features that enable the various features of the container to be employed without requiring any of the features to be bent or otherwise manipulated in such a way that can adversely affect the structural integrity of the feature. As a specific example, the tuck flange 320 enables the tab member to fold into a locked configuration without requiring a user to bend a second portion 130 of the tab member 110. Furthermore still, in some embodiments, the tab member 110 is positioned within an interior area 50 of the container. In this way, placing items in the container causes the items to come into contact with the tab member 110 in such a way that the items actually help secure the tab member 110 in a locked configuration, thereby even further preserving the integrity of the tab member.

In still other embodiments, additional features, such as drain holes 160, are positioned relative to other features so that the additional features do not unnecessarily reduce the structural strength of the container. For example, in some embodiments, the proximal end 112 of the tab member 110 is wider than the distal end 114 of the tab member 110, causing the void 150 in the first panel 100 to be wider at the proximal end 112 of the tab member 110 than at the bottom of the void 150. In some such embodiments, drain holes positioned adjacent to the void 150 are able to be positioned so that they do not extend past the overall width of the void 150. In this way, any loss of vertical strength of the first panel in association with adding the drain holes is reduced or eliminated. In some such embodiments where the tab slot 210 has the same or substantially the same width as the proximal end 112 of the tab member 110, any loss of vertical strength of the second panel in association with adding the drain holes is also reduced or eliminated.

The present invention also includes a method of determining whether the container is properly secured in a three-dimensional configuration. In some embodiments, the second panel 200 includes indicia that is visible when the tab member 110 is received by the tab slot 210. In this way, the indicia is capable of providing an indication that the container is secured in a three-dimensional configuration. In other embodiments, the tab member 110 includes indicia that is visible when the tab member 110 is not received by the tab slot 210. In this way, the indicia is capable of providing an indication that the container is not secured in a three-dimensional configuration. In still other embodiments, the tab member is configured to extend beyond one or more edge of the first panel if the tab member is folded in the wrong direction so as to provide an indication that the tab member was not folded correctly. For example, if a correct use of the tab member requires the tab member to be folded down, the tab member extends beyond a top edge of the first panel if the tab member is improperly folded upwards. As another example, if a correct use of the tab member requires the tab member to be folded up, the tab member extends beyond a bottom edge of the first panel if the tab member is improperly folded downwards.

Referring back to FIGS. 4-7, some embodiments of the present invention include one or more post panel 18*a*-18*d*. In some such embodiments, the post panel 18*a*-18*d* extends from a side folding panel 16*a*-16*d*. In other such embodiments, the post panel 18*a*-18*d* extends into an interior area 50 of the container in such a way that it is capable of providing the container with additional vertical support for stacking containers on top of each other. For instance, in some embodiments, the post panel 18*a*-18*d* has a height that is generally equal to the height of the container such that a load above the container is able to bear directly or indirectly against a top edge of the post panel 18*a*-18*d*. The load then migrates through the post panel 18*a*-18*d* and out into a support structure positioned below the container. In some such embodiments, the load above the container and/or the support structure positioned below the container is another container.

In some embodiments, one or more post panel 18*a*-18*d* is folded against another post panel so as to define a double post panel, thereby decreasing the chance that the post panel will buckle under the weight. In some embodiments, the post panel is positioned within an interior area of the container such that when items are positioned within the interior area, the items are packed around the post panel so as to increase the stability of the post panel, thereby decreasing the chance that the post panel will buckle under the weight. In some embodiments, the post panel 18*a*-18*d* extends substantially perpendicularly from one or more other panel, such as a side panel 12*a*, 12*b* and/or a side folding panel 16*a*-16*d*.

In some embodiments, the one or more post panel 18*a*-18*d* extends between multiple tab members 110. In other embodiments, the post panel 18*a*-18*d* extends through a clearance slot 170 in a tab member 110. In still other embodiments, the tab member 110 extends through a clearance hole defined by the post panel. In this way, the tab member 110 is capable of being received by one or more tab slot 7*a*-7*d* and/or the tab member 110 is capable of moving from an unlocked configuration to a locked configuration.

In other embodiments, the container defines a relatively consistent top edge that is free from notches and recesses. In some such embodiments, the entire top edge of the container is substantially defined by a single planar surface that is generally parallel with, but vertically displaced from the bottom panel of the container.

In still other embodiments, the container defines one or more hand hole 500. In some such embodiments, the end panel 14*a*, 14*b* includes a hand hole tab 510 that includes a first portion 21*a*, 21*b* hingedly coupled to the end panel 14*a*, 14*b* and a second portion 20*a*, 20*b* hingedly coupled to the first portion 21*a*, 21*b* so that the hand hole tab 510 can be folded away from the end panel to reveal the hand hole 500. In some embodiments, the hand hole 500 extends through one or more side folding panel 16*a*-16*d*. In some such embodiments, the first portion 21*a*, 21*b* of the hand hole tab 510 is configured to extend through the hand hole 500, but not beyond, the one or more side folding panel 16*a*-16*d*, resulting in the second portion 20*a*, 20*b* of the hand hole tab 510 extending into an interior area of the container. In some such embodiments, the second portion of the hand hole tab is wider than the hand hole 500 such that the hand hole tab 510 serves as an additional locking feature for securing the end panel 14*a*, 14*b* to the one or more side folding panel 16*a*-16*d*.

In some embodiments, one or more side folding panel 16*a*, 16*d* includes a hand hole receiving panel 6*a*, 6*d* hingedly coupled to the side folding panel 16*a*, 16*d*. In some such embodiments, the hand hole receiving panel 6*a*, 6*d* must be folded away from the side folding panel 16*a*, 16*d* to reveal the portion of the hand hole 500 that extends through the side folding panel 16*a*, 16*d*.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A container comprising:

a first panel having a first engagement feature;

a second panel having a second engagement feature; and a third panel having a third engagement feature, wherein said first panel is folded against said second panel and said first engagement feature of said first panel is engaged with said second engagement feature of said second panel, thereby effectively locking the container in a three-dimensional configuration, wherein said first engagement feature of said first panel is engaged with said third engagement feature of said third panel so as to prevent said first engagement feature from disengaging from said second engagement feature, and wherein said third engagement feature is displaced from said second engagement feature when the container is locked in the three-dimensional configuration, wherein said first engagement feature comprises a tab member and said second engagement feature comprises a tab slot defined by said second panel, said tab slot being configured to selectively receive said tab member so as to allow said tab member to extend into an interior area of the container such that an outer surface of said tab member can be folded against an inner surface of said second panel, thereby moving said tab member to a locked configuration, and wherein said third panel extends from a bottom edge of said first panel and wherein said third engagement feature comprises a terminal slot defined by said third panel, said terminal slot being positioned adjacent to said bottom edge of said first panel and being configured to receive a distal end of said tab member when said tab member is in the locked configuration.

2. The container of claim 1, wherein said third engagement feature further comprises a tuck flange adjacent to said terminal slot, said tuck flange being movable between an open configuration and a closed configuration, wherein said tuck flange comprises opposed proximal and distal ends, said proximal end of said tuck flange being hingedly coupled to said third panel and said distal end of said tuck flange defining an inner edge of said terminal slot when said tuck flange is in the closed configuration, wherein said tab member is free to rotate in and out of said terminal slot when said tuck flange is in the open configuration, thereby allowing the tab member to rotate towards and away from the locked configuration, respectively, and wherein said distal end of said tuck flange abuts an inner surface of said tab member when said tab member is in the locked configuration and said tuck flange is in the closed configuration, thereby inhibiting said tab member from rotating away from the locked configuration.

3. A container comprising:

a first panel having a first engagement feature;

a second panel having a second engagement feature; and a third panel having a third engagement feature, wherein said first panel is folded against said second panel and said first engagement feature of said first panel is engaged with said second engagement feature of said second panel, thereby effectively locking the container in a three-dimensional configuration, wherein said first engagement feature of said first panel is engaged with said third engagement feature of said third panel so as to prevent said first engagement feature from disengaging from said second engagement feature, wherein said third engagement feature is displaced from said second engagement feature when the container is locked in the three-dimensional configuration, wherein said first engagement feature comprises a tab member and said second engagement feature comprises an edge profile of said second panel, said edge profile being configured to allow said tab member of said first panel to extend past said second panel into an interior area of the container, and wherein said third panel extends from a bottom edge of said first panel and wherein said third engagement feature comprises a terminal slot defined by said third panel, said terminal slot being positioned adjacent to said bottom edge of said first panel and being configured to receive a distal end of said tab member when said tab member is in a locked configuration.

4. The container of claim 3, wherein said third engagement feature further comprises a tuck flange adjacent to said terminal slot, said tuck flange being movable between an open configuration and a closed configuration, wherein said tuck flange comprises opposed proximal and distal ends, said proximal end of said tuck flange being hingedly coupled to said third panel and said distal end of said tuck flange defining an inner edge of said terminal slot when said tuck flange is in the closed configuration, wherein said tab member is free to rotate in and out of said terminal slot when said tuck flange is in the open configuration, thereby allowing the tab member to rotate towards and away from the locked configuration, respectively, and wherein distal end of said tuck flange abuts an inner surface of said tab member when said tab member is in the locked configuration and said tuck flange is in the closed configuration, thereby inhibiting said tab member from rotating away from the locked configuration.

5. A container comprising:

a first panel having a first engagement feature;

a second panel having a second engagement feature, and a third panel having a third engagement feature, wherein said first panel is folded against said second panel and said first engagement feature of said first panel is engaged with said second engagement feature of said second panel, thereby effectively locking the container in a three-dimensional configuration, wherein said first engagement feature of said first panel is engaged with said third engagement feature of said third panel so as to prevent said first engagement feature from disengaging from said second engagement feature, wherein said third engagement feature is displaced from said second engagement feature when the container is locked in the three-dimensional configuration, wherein said first engagement feature comprises a tab member and a void defined by said first panel when said tab member is in a deployed configuration, wherein said second engagement feature comprises an alignment tab extending from a distal edge of said second panel, wherein said void of said first panel is configured to receive said alignment tab of said second panel when the container is in the three-dimensional configuration, and wherein said third engagement feature comprises a terminal slot defined by said third panel, said terminal slot being configured to selectively receive a distal end of said tab member so as to secure said tab member in a locked configuration.

6. The container of claim 5, wherein said third engagement feature further comprises a tuck flange adjacent to said terminal slot, said tuck flange being movable between an open configuration and a closed configuration, wherein said tab member is free to rotate in and out of said terminal slot when said tuck flange is in the open configuration, and wherein said tab member is inhibited from rotating out of said terminal slot when said tuck flange is in the closed configuration.

7. The container of claim 5, wherein said second panel defines an alignment slot extending from a proximal edge of said second panel, said alignment slot of the container being configured to selectively receive an alignment tab of another container when one of the containers is stacked on top of the other container.

8. A container comprising:

a first panel having a first engagement feature;

a second panel having a second engagement feature; and a third panel having a third engagement feature, wherein said first panel is folded against said second panel and said first engagement feature of said first panel is engaged with said second engagement feature of said second panel, thereby effectively locking the container in a three-dimensional configuration, wherein said first engagement feature of said first panel is engaged with said third engagement feature of said third panel so as to prevent said first engagement feature from disengaging from said second engagement feature, wherein said third engagement feature is displaced from said second engagement feature when the container is locked in the three-dimensional configuration, wherein said first engagement feature comprises a tab member and a void defined by said first panel when said tab member is in a deployed configuration, wherein said second engagement feature comprises a protruding member extending from said second panel, wherein said void of said first panel is configured to receive said protruding member of said second panel as the container is being moved from a flat configuration to the three-dimensional configuration, and wherein said third engagement feature comprises a terminal slot defined by said third panel, said terminal slot being configured to selectively receive a distal end of said tab member so as to secure said tab member in a locked configuration.

9. The container of claim 8, wherein said protruding member of said second panel is configured to extend beyond said void of said first panel so as to secure at least a portion of said first panel between said protruding member and said second panel.

10. The container of claim 8, wherein said first engagement feature further comprises a flange member extending into said void, said protruding member of said second panel being configured to extend over at least a portion of said flange member.

11. The container of claim 10, wherein said flange member extends from a proximal edge of said void, said proximal edge of said void being defined by a proximal end of said tab member.

12. The container of claim 8, wherein said third engagement feature further comprises a tuck flange adjacent to said terminal slot, said tuck flange being movable between an open configuration and a closed configuration, wherein said tab member is free to rotate in and out of said terminal slot when said tuck flange is in the open configuration, and wherein said tab member is inhibited from rotating out of said terminal slot when said tuck flange is in the closed configuration.

13. A method of assembling a container, the method comprising:

folding a tab member of a first engagement feature of a first panel from a stowed configuration to a deployed configuration so as to cause the first panel to form a void of the first engagement feature;

folding the first panel towards a second panel so as to cause the tab member to extend into an interior area of the container;

engaging the first engagement feature of the first panel with a second engagement feature of the second panel so as to secure the first panel to the second panel; and engaging the tab member of the first panel with a third engagement feature of a third panel so as to inhibit the first engagement feature of the first panel from disengaging from the second engagement feature of the second panel, thereby moving the container to a locked configuration, wherein the third engagement feature is displaced from the second engagement feature when the container is in the locked configuration, and wherein the method further comprises:

moving a tuck flange of the third engagement feature from a closed configuration to an open configuration so as to allow a distal end of the tab member of the first engagement feature to rotate into a terminal slot of the third engagement feature; and moving the tuck flange of the third engagement feature from the open configuration to the closed configuration such that a distal end of the tuck flange abuts an inner surface of the tab member so as to secure the distal end of the tab member of the first engagement feature within the terminal slot of the third engagement feature, thereby inhibiting the first engagement feature from becoming disengaged from the third engagement feature.

* * * * *